US010175019B1

(12) United States Patent
Al-Mutawa

(10) Patent No.: US 10,175,019 B1
(45) Date of Patent: Jan. 8, 2019

(54) TRIGGER MECHANISM FOR HAMMER FIRED-FIREARM

(71) Applicant: Mohamed Al-Mutawa, Abu Dhabi (AE)

(72) Inventor: Mohamed Al-Mutawa, Abu Dhabi (AE)

( * ) Notice: Subject to any disclaimer, the term of this patent is extended or adjusted under 35 U.S.C. 154(b) by 0 days.

(21) Appl. No.: 15/645,862

(22) Filed: Jul. 10, 2017

(51) Int. Cl.

| | |
|---|---|
| ***F41A 19/42*** | (2006.01) |
| ***F41A 19/10*** | (2006.01) |
| ***F41A 19/14*** | (2006.01) |
| ***F41A 19/12*** | (2006.01) |
| ***F41A 17/72*** | (2006.01) |

(52) U.S. Cl.
CPC ..... *F41A 19/42* (2013.01); *F41A 17/72* (2013.01); *F41A 19/10* (2013.01); *F41A 19/12* (2013.01); *F41A 19/14* (2013.01)

(58) Field of Classification Search
CPC ..... F41A 19/10; F41A 19/12; F41A 19/14; F41A 19/42; F41A 17/72
See application file for complete search history.

(56) References Cited

U.S. PATENT DOCUMENTS

| | | | | |
|---|---|---|---|---|
| 3,830,002 | A | 8/1974 | Volkmar | |
| 4,383,383 | A | 5/1983 | Landry | |
| 4,962,606 | A | 10/1990 | Pozzi | |
| 5,216,195 | A * | 6/1993 | Tuma | F41A 17/82 42/69.03 |
| 5,259,138 | A | 11/1993 | Scirica | |
| 5,303,494 | A * | 4/1994 | Tuma | F41A 17/56 42/69.03 |
| 5,400,537 | A * | 3/1995 | Meller | F41A 17/74 42/69.03 |
| 5,625,970 | A | 5/1997 | Pantuso et al. | |
| 5,666,754 | A | 9/1997 | De | |
| 5,673,506 | A | 10/1997 | Pantuso et al. | |
| 6,119,387 | A | 9/2000 | Butters et al. | |
| 6,347,473 | B1 | 2/2002 | Buffoli | |
| 6,698,125 | B2 | 3/2004 | Baker | |
| 6,769,208 | B2 | 8/2004 | Beretta | |
| 6,865,839 | B2 | 3/2005 | Bantle et al. | |
| 6,948,273 | B2 | 9/2005 | Baker | |
| 7,204,051 | B2 | 4/2007 | Thomele et al. | |

(Continued)

FOREIGN PATENT DOCUMENTS

| | | |
|---|---|---|
| WO | 9904214 | 1/1999 |

*Primary Examiner* — Stephen Johnson
*Assistant Examiner* — Joshua T Semick
(74) *Attorney, Agent, or Firm* — Kilpatrick Townsend & Stockton LLP

(57) ABSTRACT

A trigger mechanism and related methods employ translating and pivoting of a trigger bar. A method of operating a firing pin safety includes generating a movement of a trigger bar pivotally coupled with a trigger. A sear is engaged with the trigger bar during the movement of the trigger bar so as to disengage the sear from a hammer. The trigger bar is engaged with the hammer during rotation of the hammer so as to induce a rotation of the trigger bar relative to the trigger. The firing pin safety is engaged with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer.

20 Claims, 16 Drawing Sheets

(56) References Cited

U.S. PATENT DOCUMENTS

| | | | | |
|---|---|---|---|---|
| 7,500,327 | B2 | 3/2009 | Bubits | |
| 7,600,338 | B2 | 10/2009 | Geissele | |
| 7,698,845 | B2 * | 4/2010 | Hochstrate | F41A 17/72 42/69.01 |
| 7,921,589 | B1 | 4/2011 | Baker | |
| 8,037,805 | B1 | 10/2011 | Neroni | |
| 8,096,079 | B2 | 1/2012 | Zajk | |
| 8,245,427 | B2 | 8/2012 | Gomez | |
| 8,443,537 | B2 | 5/2013 | Curry | |
| 8,789,303 | B2 | 7/2014 | Curry | |
| 9,097,485 | B2 | 8/2015 | Lipowski | |
| 9,140,510 | B1 * | 9/2015 | Muska | F41A 19/42 |
| 9,267,750 | B1 | 2/2016 | Tubb | |
| 9,335,110 | B1 | 5/2016 | Heizer et al. | |
| 9,347,725 | B2 | 5/2016 | McAlister | |
| 9,915,490 | B2 * | 3/2018 | Gentilini | F41A 17/72 |
| 2017/0097204 | A1 | 4/2017 | Geissele | |

* cited by examiner

TRIGGER MECHANISM FOR HAMMER FIRED-FIREARM

BACKGROUND

Most firearms are designed to inhibit inadvertent discharge. For example, some firearms incorporate a trigger mechanism that includes a "firing pin safety" operatively coupled with the trigger and deactivated by pulling the trigger. In such trigger mechanisms, however, the deactivation of the "firing pin safety" typically interferes with the trigger pull in a way that negatively impacts the smoothness of the trigger pull. As a result, sport shooters often modify or even remove such a firing pin safety in competitions. Modifying or removing a firing pin safety can lead to inadvertent discharge, such as if the firearm is dropped, especially when a lighter trigger pull is employed.

Many existing trigger mechanisms for hammer-fired semi-automatic firearms include a trigger bar and require space under the trigger bar to accommodate semi-automatic function. The required space under the trigger bar, however, results in the barrel being placed farther away from the shooter's hand, thereby degrading operational characteristics.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In many embodiments, a trigger mechanism for hammer-fired firearms includes a translating and pivoting trigger bar pivotally coupled with the trigger. Following disconnection of the sear and the hammer resulting from pulling the trigger, the falling hammer induces a pivoting of the trigger bar that can be used to disengage a firing pin safety prior to the falling hammer inducing actuation of the firing pin. Because the firing pin safety is disengaged after disengagement of the sear, the trigger pull is only used to disconnect the sear instead of being used to disconnect the sear and disengage the firing pin safety. As a result, the trigger mechanism has a smooth trigger response. The trigger mechanism is compatible with a low bore-axis design.

Thus, in one aspect, a trigger mechanism for a hammer-fired firearm includes a trigger, a trigger bar, a trigger bar spring, a hammer, a hammer spring, and a sear. The trigger has a released configuration and a pulled configuration. The trigger bar is pivotally coupled with the trigger to rotate around a trigger bar axis. The trigger bar spring biases the trigger bar to rotate around the trigger bar axis in a biasing direction. The hammer is pivotally mounted and configured to rotate around a hammer axis between a cocked configuration and an uncocked configuration. The hammer includes a trigger bar cam configured to induce a rotation of the trigger bar around the trigger bar axis opposite to the biasing direction during a reconfiguration of the hammer from the cocked configuration to the uncocked configuration while the trigger is in the pulled configuration. The hammer spring biases the hammer to rotate around the hammer axis toward the uncocked configuration from the cocked configuration. The sear is pivotally mounted and configured to rotate around a sear axis between an engagement configuration and a disengagement configuration. The sear is configured to restrain the hammer in the cocked configuration when the sear is in the engagement configuration. The sear accommodates rotation of the hammer around the hammer axis from the cocked configuration to the uncocked configuration when the sear is in the disengagement configuration. The sear is configured to rotate from the engagement configuration to the disengagement configuration in response to a movement of the trigger bar induced by a reconfiguration of the trigger from the released configuration to the pulled configuration.

In many embodiments of the trigger mechanism, the rotation of the trigger bar is limited in the biasing direction. For example, the trigger mechanism can include a ground member configured to limit rotation of the trigger bar around the trigger bar axis in the biasing direction. In some embodiments, the ground member includes a hammer pivot pin by which the hammer is pivotally mounted to a frame of the hammer-fired firearm.

In many embodiments of the trigger mechanism, the sear is biased towards engagement with the hammer. For example, in many embodiments, the trigger mechanism includes a sear spring that biases the sear to rotate around the sear axis toward the engagement configuration from the disengagement configuration.

In some embodiments, the trigger mechanism provides a two-stage trigger pull. For example, the trigger bar can include a first engagement surface and a second engagement surface. The first engagement surface can be configured to engage the sear during a first portion of the movement of the trigger bar induced by the reconfiguration of the trigger from the released configuration to the pulled configuration without inducing disengagement between the sear and the hammer. The second engagement surface can be configured to engage the sear during a second portion of the movement of the trigger bar induced by the reconfiguration of the trigger from the released configuration to the pulled configuration so as to induce disengagement between the sear and the hammer. The first engagement surface can be oriented substantially normal to the movement of the trigger bar induced by the reconfiguration of the trigger from the released configuration to the pulled configuration. The second engagement surface can be angled relative to the first engagement surface by 40 degrees or more.

In many embodiments, the trigger mechanism is configured to block rotation of the hammer in the advent of disconnection of the sear from the hammer when the trigger is in the released configuration. For example, in many embodiments, the trigger bar is configured to interface with the trigger bar cam to block a rotation of the hammer toward the uncocked configuration when the trigger is in the released configuration.

In many embodiments, the trigger mechanism provides semi-automatic functionality. For example, in many embodiments, when the trigger is in the pulled configuration, the trigger bar is configured to (a) rotate around the trigger bar axis in the biasing direction into engagement with the sear during a reconfiguration of the hammer from the uncocked configuration to the cocked configuration, and (b) accommodate reengagement of the sear with the hammer during the reconfiguration of the hammer from the uncocked configuration to the cocked configuration to restrain the hammer in the cocked configuration. In many embodiments, the trigger bar is configured to disengage from the sear during a reconfiguration of the trigger from the pulled configuration to the released configuration.

In many embodiments, the trigger mechanism includes a firing pin safety that is automatically disengaged after disengagement of the sear from the hammer. For example, in many embodiments, the trigger mechanism includes a firing pin and a firing pin safety. The firing pin is configured to be actuated by the hammer during a reconfiguration of the hammer from the cocked configuration to the uncocked configuration. The firing pin safety has an engaged configuration and a disengaged configuration. The firing pin safety is configured to (a) prevent actuation of the firing pin by the hammer when the firing pin safety is in the engaged configuration, (b) accommodate actuation of the firing pin by the hammer when the firing pin safety is in the disengaged configuration, and (c) reconfigure from the engaged configuration to the disengaged configuration during the rotation of the trigger bar around the trigger bar axis opposite to the biasing direction during the reconfiguration of the hammer from the cocked configuration to the uncocked configuration while the trigger is in the pulled configuration. In many embodiments, the firing pin safety includes a firing pin safety spring configured to reconfigure the firing pin safety from the disengaged configuration to the engaged configuration in response to a rotation of the trigger bar around the first pivot axis in the biasing direction induced by a reconfiguration of the hammer from the uncocked configuration to the cocked configuration.

In another aspect, a method of operating a firing pin safety of a hammer-fired firearm is provided. The method includes generating a movement of a trigger bar pivotally coupled with a trigger by reconfiguring the trigger from a released configuration to a pulled configuration. A sear is engaged with the trigger bar during the movement of the trigger bar so as to disengage the sear from a hammer in a cocked configuration. While the trigger is in the pulled configuration, the trigger bar is engaged with the hammer during a reconfiguration of the hammer from the cocked configuration to an uncocked configuration so as to induce a rotation of the trigger bar relative to the trigger. The firing pin safety is engaged with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer. In many embodiments, the method of operating a firing pin safety of a hammer-fired firearm includes reconfiguring the firing pin safety from the disengaged configuration to the engaged configuration in response to a rotation of the trigger bar induced by a reconfiguration of the hammer from the uncocked configuration to the cocked configuration.

In many embodiments of the method of operating a firing pin safety of a hammer-fired firearm, the rotation of the trigger bar is limited. For example, the method can include (a) biasing the trigger bar to rotate relative to the trigger with a trigger bar spring coupled with the trigger bar, and (b) limiting rotation of the trigger bar via a ground member when the trigger is in the released configuration.

In many embodiments of the method of operating a firing pin safety of a hammer-fired firearm, the sear is biased towards engagement with the hammer. For example, in many embodiments, the method includes biasing the sear into engagement with the hammer with a sear spring coupled with the sear.

In some embodiments, the method of operating a firing pin safety of a hammer-fired firearm provides a two-stage trigger pull. For example, the method can include (a) engaging the sear with a first surface of the trigger bar during a first portion of the movement of the trigger bar without inducing disengagement between the sear and the hammer, and (b) engaging the sear with a second surface of the trigger bar during a second portion of the movement of the trigger bar so as to induce disengagement between the sear and the hammer. The second surface can be angled relative to the first surface by 40 degrees or more.

In many embodiments, the method of operating a firing pin safety of a hammer-fired firearm includes blocking rotation of the hammer in the advent of disconnection of the sear from the hammer when the trigger is in the released configuration. For example, in many embodiments, the method includes interfacing the trigger bar with the hammer to block a rotation of the hammer to the uncocked configuration when the trigger is in the released configuration.

In many embodiments, the method of operating a firing pin safety of a hammer-fired firearm provides semi-automatic functionality. For example, in many embodiments, the method includes, while the trigger is in the pulled configuration, (a) rotating the trigger bar relative to the trigger into engagement with the sear during a reconfiguration of the hammer from the uncocked configuration to the cocked configuration, and (b) reengaging the sear with the hammer during the reconfiguration of the hammer from the uncocked configuration to the cocked configuration to restrain the hammer in the cocked configuration. In many embodiments, the method of operating a firing pin safety of a hammer-fired firearm includes disengaging the trigger bar from the sear during a reconfiguration of the trigger from the pulled configuration to the released configuration.

In another aspect, a method is provided for blocking rotation of a hammer to prevent actuation of a firing pin when a trigger of a hammer-fired firearm is in a released configuration. The method includes pivotally supporting a trigger bar from a trigger having a released configuration. The trigger bar is biased into a fix configuration relative to the trigger in the released configuration. The hammer is restrained in a cocked configuration via a sear. In response to a disconnection of the sear from the hammer with the trigger in the released configuration, rotation of the hammer from the cocked configuration to an uncocked configuration is blocked with the trigger bar.

In another aspect, a trigger mechanism for a hammer-fired firearm includes a trigger, a trigger bar, a trigger bar spring, a hammer, a hammer spring, and a sear. The trigger has a released configuration and a pulled configuration. The trigger bar is pivotally coupled with the trigger to rotate around a trigger bar axis relative to the trigger. The trigger bar spring biases the trigger bar to rotate around the trigger bar axis in a biasing direction. The hammer has a cocked configuration and an uncocked configuration. The hammer is configured to induce a rotation of the trigger bar around the trigger bar axis opposite to the biasing direction during a reconfiguration of the hammer from the cocked configuration to the uncocked configuration while the trigger is in the pulled configuration. The hammer spring biases the hammer toward the uncocked configuration from the cocked configuration. The sear has an engagement configuration and a disengagement configuration. The sear is configured to restrain the hammer in the cocked configuration when the sear is in the engagement configuration. The sear accommodates reconfiguration of the hammer from the cocked configuration to the uncocked configuration when the sear is in the disengagement configuration. The sear is configured to reconfigure from the engagement configuration to the disengagement configuration in response to a movement of the trigger bar induced by a reconfiguration of the trigger from the released configuration to the pulled configuration.

In many embodiments of the trigger mechanism, the rotation of the trigger bar is limited in the biasing direction. For example, the trigger mechanism can include a ground member configured to limit rotation of the trigger bar around the trigger bar axis in the biasing direction. In some embodiments, the ground member includes a hammer pivot pin by which the hammer is mounted to a frame of the hammer-fired firearm.

In many embodiments of the trigger mechanism, the sear is biased towards engagement with the hammer. For example, in many embodiments, the trigger mechanism includes a sear spring that biases the sear toward the engagement configuration from the disengagement configuration.

In some embodiments, the trigger mechanism provides a two-stage trigger pull. For example, the trigger bar can include a first engagement surface and a second engagement surface. The first engagement surface can be configured to engage the sear during a first portion of the movement of the trigger bar induced by the reconfiguration of the trigger from the released configuration to the pulled configuration without inducing disengagement between the sear and the hammer. The second engagement surface can be configured to engage the sear during a second portion of the movement of the trigger bar induced by the reconfiguration of the trigger from the released configuration to the pulled configuration so as to induce disengagement between the sear and the hammer. The first engagement surface can be oriented substantially normal to the movement of the trigger bar induced by the reconfiguration of the trigger from the released configuration to the pulled configuration. The second engagement surface can be angled relative to the first engagement surface by any suitable angle (e.g., an angle in a range from 30 degrees to 90 degrees).

In many embodiments, the trigger mechanism is configured to block rotation of the hammer in the advent of disconnection of the sear from the hammer when the trigger is in the released configuration. For example, in many embodiments, the trigger bar is configured to interface with the hammer to block a reconfiguration of the hammer to the uncocked configuration when the trigger is in the released configuration.

In many embodiments, the trigger mechanism provides semi-automatic functionality. For example, in many embodiments, when the trigger is in the pulled configuration, the trigger bar is configured to (a) rotate around the trigger bar axis in the biasing direction into engagement with the sear during a reconfiguration of the hammer from the uncocked configuration to the cocked configuration, and (b) accommodate reengagement of the sear with the hammer during the reconfiguration of the hammer from the uncocked configuration to the cocked configuration to restrain the hammer in the cocked configuration. In many embodiments, the trigger bar is configured to disengage from the sear during a reconfiguration of the trigger from the pulled configuration to the released configuration.

In many embodiments, the trigger mechanism includes a firing pin safety that is automatically disengaged after disengagement of the sear from the hammer. For example, in many embodiments, the trigger mechanism includes a firing pin and a firing pin safety. The firing pin is configured to be actuated by the hammer during a reconfiguration of the hammer from the cocked configuration to the uncocked configuration. The firing pin safety has an engaged configuration and a disengaged configuration. The firing pin safety is configured to (a) prevent actuation of the firing pin by the hammer when the firing pin safety is in the engaged configuration, (b) accommodate actuation of the firing pin by the hammer when the firing pin safety is in the disengaged configuration, and (c) reconfigure from the engaged configuration to the disengaged configuration during the rotation of the trigger bar around the trigger bar axis opposite to the biasing direction during the reconfiguration of the hammer from the cocked configuration to the uncocked configuration while the trigger is in the pulled configuration. In many embodiments, the firing pin safety includes a firing pin safety spring configured to reconfigure the firing pin safety from the disengaged configuration to the engaged configuration in response to a rotation of the trigger bar around the first pivot axis in the biasing direction induced by a reconfiguration of the hammer from the uncocked configuration to the cocked configuration.

In another aspect, a method of controlling articulation of a hammer in a hammer-fired firearm is provided. The method includes restraining the hammer in a cocked configuration via a sear engaged with the hammer. A movement of a trigger bar pivotally coupled with a trigger is generated by reconfiguring the trigger from a released configuration to a pulled configuration. A sear is engaged with the trigger bar during the movement of the trigger bar so as to disengage the sear from the hammer. In response to the disengagement of the sear from the hammer, the hammer is reconfigured from the cocked configuration to an uncocked configuration while the trigger is in the pulled configuration. While the trigger is in the pulled configuration, the trigger bar is engaged by the hammer during the reconfiguration of the hammer from the cocked configuration to the uncocked configuration so as to induce a rotation of the trigger bar relative to the trigger.

In many embodiments, the method of controlling articulation of a hammer in a hammer-fired firearm includes reconfiguring a firing pin safety during reconfiguration of the hammer from the cocked configuration to the uncocked configuration. For example, the method of controlling articulation of a hammer in a hammer-fired firearm can include engaging a firing pin safety with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer.

The method of controlling articulation of a hammer in a hammer-fired firearm can further include preventing engagement of the firing pin by the hammer when the trigger is in the released configuration. For example, the method of controlling articulation of a hammer in a hammer-fired firearm can further include interfacing the trigger bar with the hammer to prevent engagement of the firing pin by the hammer when the trigger is in the released configuration.

The method of controlling articulation of a hammer in a hammer-fired firearm can further include reengagement of the firing pin safety during cycling of the action of the firearm. For example, the method of controlling articulation of a hammer in a hammer-fired firearm can further include reconfiguring the firing pin safety from the disengaged configuration to the engaged configuration in response to a rotation of the trigger bar induced by a reconfiguration of the hammer from the uncocked configuration to the cocked configuration.

In many embodiments, the method of controlling articulation of a hammer in a hammer-fired firearm includes controlling orientation of the trigger bar when the trigger is in the released configuration. For example, the method of controlling articulation of a hammer in a hammer-fired firearm can include (a) biasing the trigger bar to rotate relative to the trigger with a trigger bar spring coupled with the trigger bar, and (b) limiting rotation of the trigger bar via a ground member when the trigger is in the released configuration.

In many embodiments, the method of controlling articulation of a hammer in a hammer-fired firearm includes controlling orientation of the sear. For example, the method of controlling articulation of a hammer in a hammer-fired firearm can include biasing the sear into engagement with the hammer with a sear spring coupled with the sear.

The method of controlling articulation of a hammer in a hammer-fired firearm can provide a two-stage trigger pull. For example, the method of controlling articulation of a hammer in a hammer-fired firearm can include (a) engaging the sear with a first surface of the trigger bar during a first portion of the movement of the trigger bar without inducing disengagement between the sear and the hammer, and (b) engaging the sear with a second surface of the trigger bar during a second portion of the movement of the trigger bar so as to induce disengagement between the sear and the hammer. The second surface can be angled relative to the first surface by a suitable angle (e.g., between 30 degrees and 90 degrees).

The method of controlling articulation of a hammer in a hammer-fired firearm can provide semi-automatic functionality. For example, the method of controlling articulation of a hammer in a hammer-fired firearm can include, while the trigger is in the pulled configuration, (a) rotating the trigger bar relative to the trigger into engagement with the sear during a reconfiguration of the hammer from the uncocked configuration to the cocked configuration, and (b) reengaging the sear with the hammer during the reconfiguration of the hammer from the uncocked configuration to the cocked configuration to restrain the hammer in the cocked configuration. The method of controlling articulation of a hammer in a hammer-fired firearm can include disengaging the trigger bar from the sear during a reconfiguration of the trigger from the pulled configuration to the released configuration.

In another aspect, a hammer safety mechanism is described that is configured to block engagement of a firing pin by a hammer when a trigger of a hammer-fired firearm is in a released configuration. The hammer safety mechanism includes a trigger, a hammer, and a trigger bar. The trigger has a released configuration and a pulled configuration. The hammer is operable to be restrained in a cocked configuration via a sear. The trigger bar is pivotally coupled with the trigger and biased into a fixed orientation relative to the trigger in the released configuration. The trigger bar is configured to, in response to a disconnection of the sear from the hammer with the trigger in the released configuration, block engagement of the firing pin by the hammer.

In many embodiments of the hammer safety mechanism, the trigger bar rotates relative to the trigger. For example, in many embodiments, the hammer is configured to induce a rotation of the trigger bar relative to the trigger during a reconfiguration of the hammer from the cocked configuration to an uncocked configuration while the trigger is in a pulled configuration.

In many embodiments, the hammer safety mechanism includes a firing pin safety. For example, in many embodiments, the hammer safety mechanism includes a firing pin safety having an engaged configuration and a disengaged configuration. In many embodiments, the firing pin safety is configured to (a) prevent actuation of the firing pin by the hammer when the firing pin safety is in the engaged configuration, (b) accommodate actuation of the firing pin by the hammer when the firing pin safety is in the disengaged configuration, and (c) reconfigure from the engaged configuration to the disengaged configuration during the rotation of the trigger bar induced by the reconfiguration of the hammer from the cocked configuration to the uncocked configuration while the trigger is in a pulled configuration.

In many embodiments, the hammer safety mechanism is configured to control orientation of the trigger bar when the trigger is in the released configuration. For example, the hammer safety mechanism can include a ground member configured to limit rotation of the trigger bar in a biasing direction relative to the trigger when the trigger is in the release configuration. The ground member can include a hammer pivot pin by which the hammer is mounted to a frame of the hammer-fired firearm.

In many embodiments of the hammer safety mechanism, the sear is biased into engagement with the hammer. For example, the hammer safety mechanism can include a sear spring biasing the sear into engagement with the hammer in the cocked configuration.

In many embodiments, the hammer safety mechanism provides a two-stage trigger pull. For example, in many embodiments the trigger bar includes (a) a first engagement surface configured to engage the sear during a first portion of a movement of the trigger bar induced by the reconfiguration of the trigger from the released configuration to the pulled configuration without inducing disengagement between the sear and the hammer, and (b) a second engagement surface configured to engage the sear during a second portion of the movement of the trigger bar induced by the reconfiguration of the trigger from the released configuration to the pulled configuration so as to induce disengagement between the sear and the hammer. The first engagement surface can be oriented substantially normal to the movement of the trigger bar induced by the reconfiguration of the trigger from the released configuration to the pulled configuration. The second engagement surface can be angled relative to the first engagement surface by a suitable angle (e.g., 30 degrees to 90 degrees).

In many embodiments, the hammer safety mechanism provides semi-automatic functionality. For example, when the trigger is in a pulled configuration, the trigger bar can be configured to (a) rotate into engagement with the sear during a reconfiguration of the hammer from the uncocked configuration to the cocked configuration, and (b) accommodate reengagement of the sear with the hammer during the reconfiguration of the hammer from the uncocked configuration to the cocked configuration to restrain the hammer in the cocked configuration. The trigger bar can be configured to disengage from the sear during a reconfiguration of the trigger from the pulled configuration to the released configuration.

In another aspect, a method of blocking engagement of a firing pin by a hammer of a hammer-fired firearm when a trigger of the hammer-fired firearm is in a released configuration is provided. The method includes pivotally supporting a trigger bar from a trigger having a released configuration and a pulled configuration. The trigger bar is biased into a fixed orientation relative to the trigger in the released configuration. The hammer is restrained in a cocked configuration via a sear. In response to a disconnection of the sear from the hammer while the trigger is in the released configuration, engagement of the firing pin by the hammer is blocked with the trigger bar. In many embodiments, biasing the trigger bar into a fixed configuration relative to the trigger in the released configuration includes applying a biasing force to the trigger bar via a trigger bar spring.

In many embodiments, the method of blocking engagement of the firing pin by the hammer includes inducing rotation of the trigger bar relative to the trigger. For example, the method can include (a) generating a movement of the trigger bar by reconfiguring the trigger from the released configuration to the pulled configuration, (b) engaging the sear with the trigger bar during the movement of the trigger bar so as to disengage the sear from the hammer in the cocked configuration, and (c) while the trigger is in the pulled configuration, engaging the trigger bar with the hammer during a reconfiguration of the hammer from the cocked configuration to an uncocked configuration so as to induce a rotation of the trigger bar relative to the trigger.

The method of blocking engagement of the firing pin by the hammer can include disengaging a firing pin safety. For example, the method can include engaging a firing pin safety with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer. The method can include biasing the firing pin safety toward the engagement configuration via a firing pin safety spring. Reconfiguring the firing pin safety from the engaged configuration to the disengaged configuration can include disengaging the firing pin safety from the firing pin.

In many embodiments, the method of blocking engagement of the firing pin by the hammer includes biasing the sear into engagement with the hammer. For example, the method can include biasing the sear into engagement with the hammer with a sear spring coupled with the sear.

The method of blocking engagement of the firing pin by the hammer can provide a two-stage trigger pull. For example, the method can include (a) engaging the sear with a first surface of the trigger bar during a first portion of the movement of the trigger bar without inducing disengagement between the sear and the hammer, and (b) engaging the sear with a second surface of the trigger bar during a second portion of the movement of the trigger bar so as to induce disengagement between the sear and the hammer, the second surface being angled relative to the first surface by between 30 degrees to 90 degrees.

The method of blocking engagement of the firing pin by the hammer can provide semi-automatic functionality. For example, the method can include, while the trigger is in the pulled configuration, (a) reconfiguring the hammer from the uncocked configuration to the cocked configuration while the trigger is in the pulled configuration, (b) rotating the trigger bar relative to the trigger into engagement with the sear during the reconfiguration of the hammer from the uncocked configuration to the cocked configuration, and (c) reengaging the sear with the hammer during the reconfiguration of the hammer from the uncocked configuration to the cocked configuration to restrain the hammer in the cocked configuration. The method can further include disengaging the trigger bar from the sear during a reconfiguration of the trigger from the pulled configuration to the released configuration.

In another aspect, a firing pin safety mechanism for a hammer-fired firearm is described. The firing pin safety mechanism includes a trigger, a trigger bar, a hammer, a firing pin, and a firing pin safety. The trigger has a release configuration and a pulled configuration. The trigger bar is pivotally coupled with the trigger for rotation around a trigger bar axis. The hammer is reconfigurable between a cocked configuration and an uncocked configuration. The hammer is configured to induce a rotation of the trigger bar around the trigger bar axis during a reconfiguration of the hammer from the cocked configuration to the uncocked configuration. The firing pin is configured to be struck by the hammer to actuate the firing pin. The firing pin safety is reconfigurable between an engaged configuration and a disengaged configuration. The firing pin safety blocks actuation of the firing pin when in the engaged configuration. The firing pin safety accommodates actuation of the firing pin when in the disengaged configuration. The firing pin safety is reconfigured from the engaged configuration to the disengaged configuration in response to the rotation of the trigger bar around the trigger bar axis during the reconfiguration of the hammer from the cocked configuration to the uncocked configuration.

In many embodiments, the firing pin safety mechanism is configured to control orientation of the trigger bar when the trigger is in the released configuration. For example, the firing pin safety mechanism can include a ground member configured to limit rotation of the trigger bar around the trigger bar axis in a biasing direction when the trigger. The ground member can include a hammer pivot pin by which the hammer is mounted to a frame of the hammer-fired firearm.

In many embodiments, the firing pin safety mechanism includes a sear for controlling articulation of the hammer. The sear can be reconfigurable between an engagement configuration and a disengagement configuration. The sear can be configured to restrain the hammer in the cocked configuration when the sear is in the engagement configuration and accommodate reconfiguration of the hammer from the cocked configuration to the uncocked configuration when the sear is in the disengagement configuration. In many embodiments, the sear can be reconfigured from the engagement configuration to the disengagement configuration in response to a movement of the trigger bar induced by a reconfiguration of the trigger from the released configuration to the pulled configuration.

The firing pin safety mechanism can provide a two-stage trigger pull. For example, in many embodiments of the firing pin safety mechanism, the trigger bar includes (a) a first engagement surface configured to engage the sear during a first portion of the movement of the trigger bar induced by the reconfiguration of the trigger from the released configuration to the pulled configuration without inducing disengagement between the sear and the hammer, and (b) a second engagement surface configured to engage the sear during a second portion of the movement of the trigger bar induced by the reconfiguration of the trigger from the released configuration to the pulled configuration so as to induce disengagement between the sear and the hammer. The first engagement surface can be oriented substantially normal to the movement of the trigger bar induced by the reconfiguration of the trigger from the released configuration to the pulled configuration. The second engagement surface can be angled relative to the first engagement surface by a suitable angle (e.g., 30 degrees to 90 degrees).

The firing pin safety mechanism can provide a hammer safety that blocks engagement of the firing pin by the hammer when the trigger is in the release configuration. For example, the trigger bar can be configured to interface with the hammer to block reconfiguration of the hammer to the uncocked configuration when the trigger is in the released configuration.

The firing pin safety mechanism can provide semi-automatic functionality. For example, when the trigger is in the pulled configuration, the trigger bar can be configured to (a) rotate around the trigger bar axis in the biasing direction into engagement with the sear during a reconfiguration of the hammer from the uncocked configuration to the cocked configuration, and (b) accommodate reengagement of the sear with the hammer during the reconfiguration of the hammer from the uncocked configuration to the cocked configuration to restrain the hammer in the cocked configuration. The trigger bar can be configured to disengage from the sear during a reconfiguration of the trigger from the pulled configuration to the released configuration.

In many embodiments, the firing pin safety is biased towards the engagement configuration. For example, the firing pin safety mechanism can include a firing pin safety spring configured to reconfigure the firing pin safety from the disengaged configuration to the engaged configuration in response to a rotation of the trigger bar induced by a reconfiguration of the hammer from the uncocked configuration to the cocked configuration.

In another aspect, a method of operating a firing pin safety of a hammer-fired firearm is provided. The method includes generating a movement of a trigger bar pivotally coupled with a trigger by reconfiguring the trigger from a released configuration to a pulled configuration. A sear is engaged with the trigger bar during the movement of the trigger bar so as to disengage the sear from a hammer in a cocked configuration. While the trigger is in the pulled configuration, the trigger bar is engaged with the hammer during a reconfiguration of the hammer from the cocked configuration to an uncocked configuration so as to induce a rotation of the trigger bar relative to the trigger. The firing pin safety is engaged with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer. In many embodiments, the method of operating a firing pin safety of a hammer-fired firearm includes reconfiguring the firing pin safety from the disengaged configuration to the engaged configuration in response to a rotation of the trigger bar induced by a reconfiguration of the hammer from the uncocked configuration to the cocked configuration.

In many embodiments of the method of operating a firing pin safety of a hammer-fired firearm, the rotation of the trigger bar is limited. For example, the method can include (a) biasing the trigger bar to rotate relative to the trigger with a trigger bar spring coupled with the trigger bar, and (b) limiting rotation of the trigger bar via a ground member when the trigger is in the released configuration.

In many embodiments of the method of operating a firing pin safety of a hammer-fired firearm, the sear is biased towards engagement with the hammer. For example, in many embodiments, the method includes biasing the sear into engagement with the hammer with a sear spring coupled with the sear.

In some embodiments, the method of operating a firing pin safety of a hammer-fired firearm provides a two-stage trigger pull. For example, the method can include (a) engaging the sear with a first surface of the trigger bar during a first portion of the movement of the trigger bar without inducing disengagement between the sear and the hammer, and (b) engaging the sear with a second surface of the trigger bar during a second portion of the movement of the trigger bar so as to induce disengagement between the sear and the hammer. The second surface can be angled relative to the first surface by 40 degrees or more.

In many embodiments, the method of operating a firing pin safety of a hammer-fired firearm includes blocking rotation of the hammer in the advent of disconnection of the sear from the hammer when the trigger is in the released configuration. For example, in many embodiments, the method includes interfacing the trigger bar with the hammer to block a rotation of the hammer to the uncocked configuration when the trigger is in the released configuration.

In many embodiments, the method of operating a firing pin safety of a hammer-fired firearm provides semi-automatic functionality. For example, in many embodiments, the method includes, while the trigger is in the pulled configuration, (a) rotating the trigger bar relative to the trigger into engagement with the sear during a reconfiguration of the hammer from the uncocked configuration to the cocked configuration, and (b) reengaging the sear with the hammer during the reconfiguration of the hammer from the uncocked configuration to the cocked configuration to restrain the hammer in the cocked configuration. In many embodiments, the method of operating a firing pin safety of a hammer-fired firearm includes disengaging the trigger bar from the sear during a reconfiguration of the trigger from the pulled configuration to the released configuration.

In many embodiments, the method of operating a firing pin safety of a hammer-fired firearm provides for reengagement of the firing pin safety. For example, the method of operating a firing pin safety of a hammer-fired firearm can include reconfiguring the firing pin safety from the disengaged configuration to the engaged configuration in response to a rotation of the trigger bar induced by a reconfiguration of the hammer from the uncocked configuration to the cocked configuration. The method of operating a firing pin safety of a hammer-fired firearm can include biasing the firing pin safety toward the engagement configuration via a firing pin safety spring. Reconfiguring the firing pin safety from the engaged configuration to the disengaged configuration can include disengaging the firing pin safety from the firing pin.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. It will, however, also be apparent to one skilled in the art that the present invention may be practiced without the specific details. Furthermore, well-known features may be omitted or simplified in order not to obscure the embodiment being described.

Figure 1:
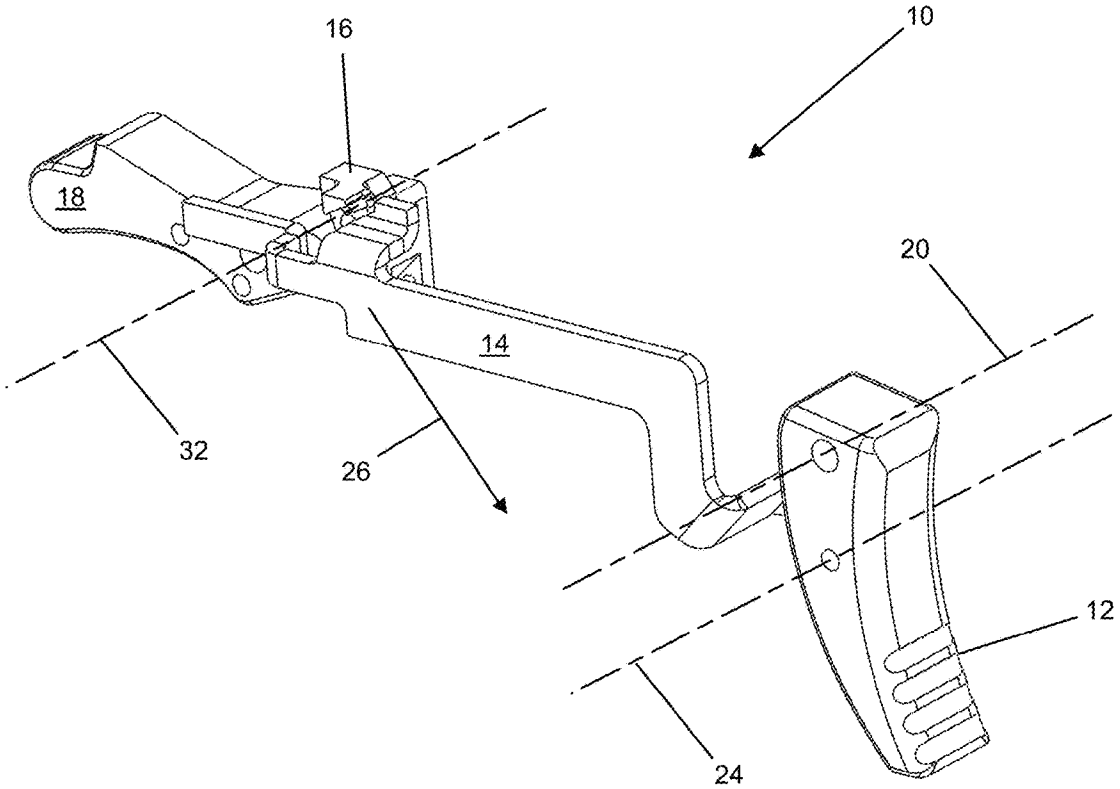
FIG. 1 is a three-dimensional view of a trigger mechanism, in accordance with embodiments.

Referring now to the drawings, in which like reference numerals represent like parts throughout the several views, FIG. 1 shows a three-dimensional view of a trigger mechanism 10 for a hammer-fired firearm, in accordance with embodiments. The trigger mechanism 10 includes a trigger 12, a trigger bar 14, a sear 16, and a hammer 18.

The trigger 12 is pivotally mounted to a frame of the hammer-fired firearm to rotate relative to the frame around a trigger axis 20 between a released configuration (illustrated in FIG. 1) and a pulled configuration. In many embodiments, the trigger 12 is held in the released configuration by a force applied to the trigger 12 by the trigger bar 14, which holds the trigger 12 in contact with a stop feature 22 (shown in FIG. 2), which can be included in the frame. From the released configuration, the trigger 12 is pulled to rotate the trigger 12 clockwise around the trigger axis 20 (relative to the view of FIG. 1) to the pulled configuration.

The trigger bar 14 is pivotally mounted to the trigger 12 to rotate relative to the trigger around a trigger bar axis 24. In many embodiments, the trigger mechanism 10 includes a trigger bar spring that applies a tension force to the trigger bar 14 in a trigger bar spring direction 26, which has forward and downward components relative to the view of FIG. 1. Accordingly, the trigger bar spring biases the trigger bar 14 towards the right with respect to view shown in FIG. 1 and to rotate counter-clockwise around the trigger bar axis 24 with respect to the view shown in FIG. 1. In the configuration shown in FIG. 1, the trigger bar spring holds the trigger bar 14 in contact with a hammer pivot pin 28 (shown in FIG. 2) by which the hammer 18 is pivotally mounted to the frame.

The sear 16 is pivotally mounted to the frame to rotate relative to the frame around a sear axis 30 (shown in FIG. 2) between an engagement configuration and a disengagement configuration. In the engagement configuration, the sear 16 restrains the hammer 18 in a cocked configuration. In the disengagement configuration, the sear 16 accommodates rotation of the hammer 18 from the cocked configuration to an uncocked configuration. In many embodiments, the trigger mechanism 10 includes a sear spring that biases the sear 16 towards the engagement configuration.

The hammer 18 is pivotally mounted to the frame via the hammer pivot pin 28 to rotate around a hammer axis 32 between the cocked configuration and an uncocked configuration. In many embodiments, the trigger mechanism 10 includes a hammer spring that biases the hammer 18 towards the uncocked configuration.

Figure 2:
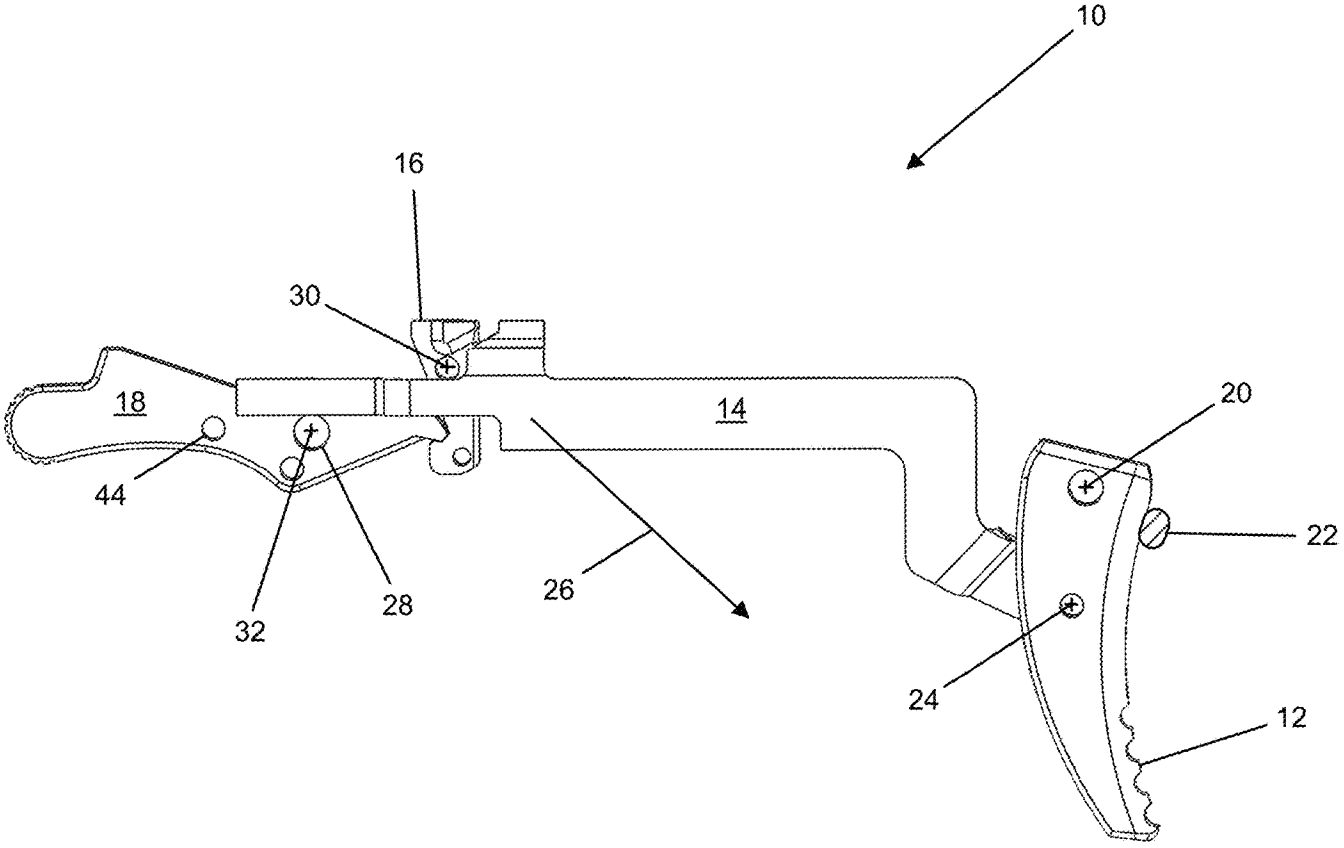
FIG. 2 is a side view of a starting configuration of the trigger mechanism of FIG. 1.

FIG. 2 is a side view of the trigger mechanism 10 in a starting configuration in which the trigger 12 is in the released configuration. In the starting configuration, the trigger bar spring applies the trigger bar spring force in the trigger bar spring direction 26. The trigger bar 14 transmits a forward and downward acting force (to the right and downward in FIG. 2) to the trigger 12, thereby orienting the trigger 12 by pressing the trigger 12 against the stop feature 22. Contact between the trigger bar 14 and the hammer pivot pin 28, in combination with the trigger bar spring force applied to the trigger bar 14 in the trigger bar spring direction 26, orients the trigger bar 14 relative to the trigger bar axis 24 in the starting configuration.

In the starting configuration, the sear 16 is in the engagement configuration in which the sear 16 restrains the hammer 18 in the cocked configuration. In the illustrated embodiment, the trigger bar 14 is not in contact with the sear 16, thereby providing an initial amount of travel of the trigger 12 prior to bringing the trigger bar 14 into contact with the sear 16.

Figure 3:
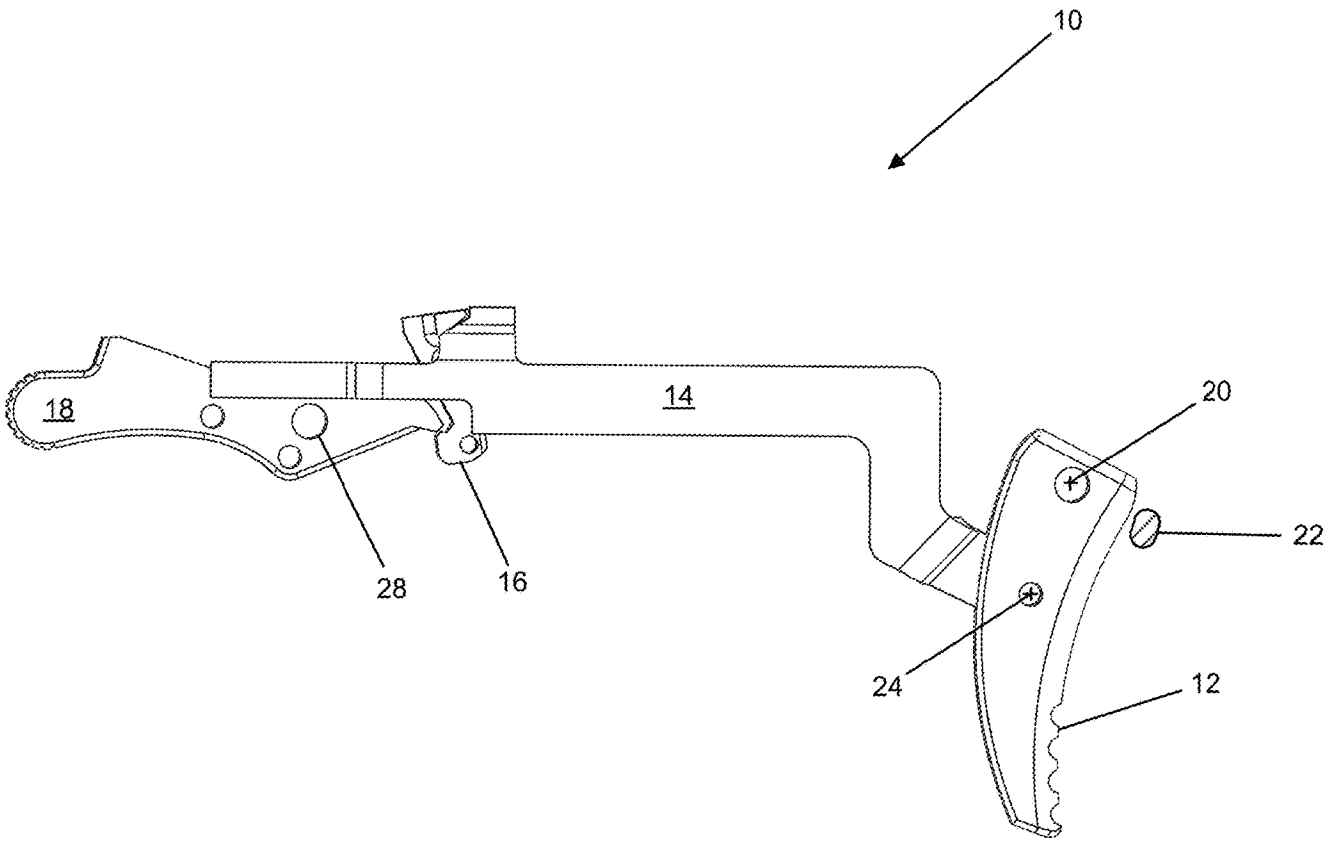
FIG. 3 is a side view illustrating disconnection of the sear via the trigger bar in the trigger mechanism of FIG. 1.

FIG. 3 is a side view of the trigger mechanism 10 illustrating disconnection of the sear 16 via movement of the trigger bar 14 induced by pulling the trigger 12. As the trigger 12 is pulled, the trigger bar 14 slides along the hammer pivot pin 28 into contact with the sear 16 due to being pivotally attached to the trigger 12 and being biased into contact with the hammer pivot pin 28 via the trigger bar spring. Following initial contact between the trigger bar 14 and the sear 16, further pulling of the trigger 12 generates further movement of the trigger bar 14 that induces rotation of the sear 16 from the engagement configuration shown in FIG. 2 to the disengagement configuration shown in FIG. 3. In the disengagement configuration, the sear 16 releases the hammer 18 and accommodates rotation of the hammer 18 from the cocked configuration to the uncocked configuration induced by the hammer spring.

Figure 4:
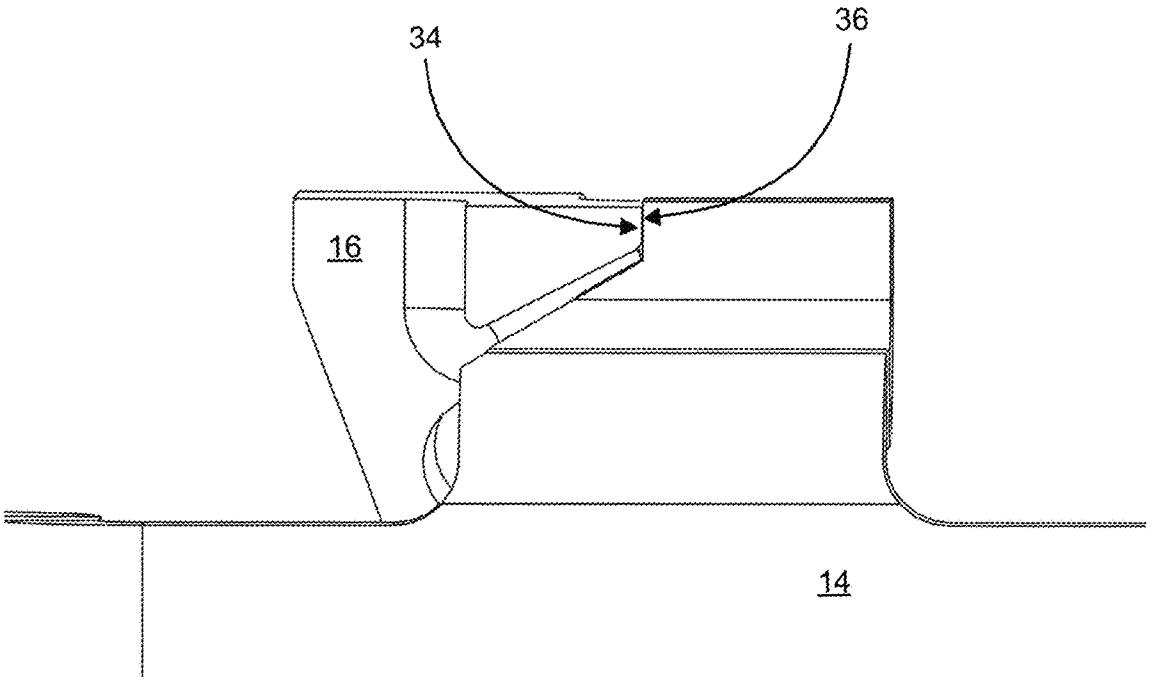
FIG. 4 is a close-up side view illustrating initial engagement of a first surface of the trigger bar with a first surface of the sear prior to disconnection of the sear from the hammer in the trigger mechanism of FIG. 1.
Figure 5:
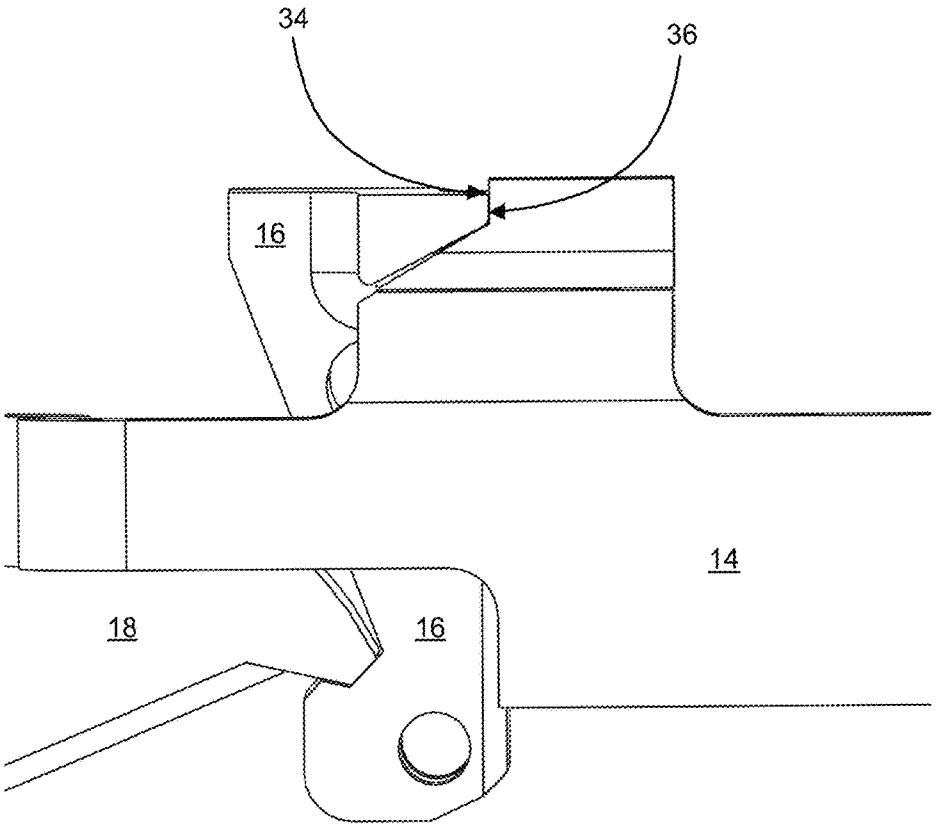
FIG. 5 and FIG. 6 are close-up side views illustrating engagement of a second surface of the trigger bar with a second surface of the sear to enable disconnection of the sear from the hammer in the trigger mechanism of FIG. 1.
Figure 6:
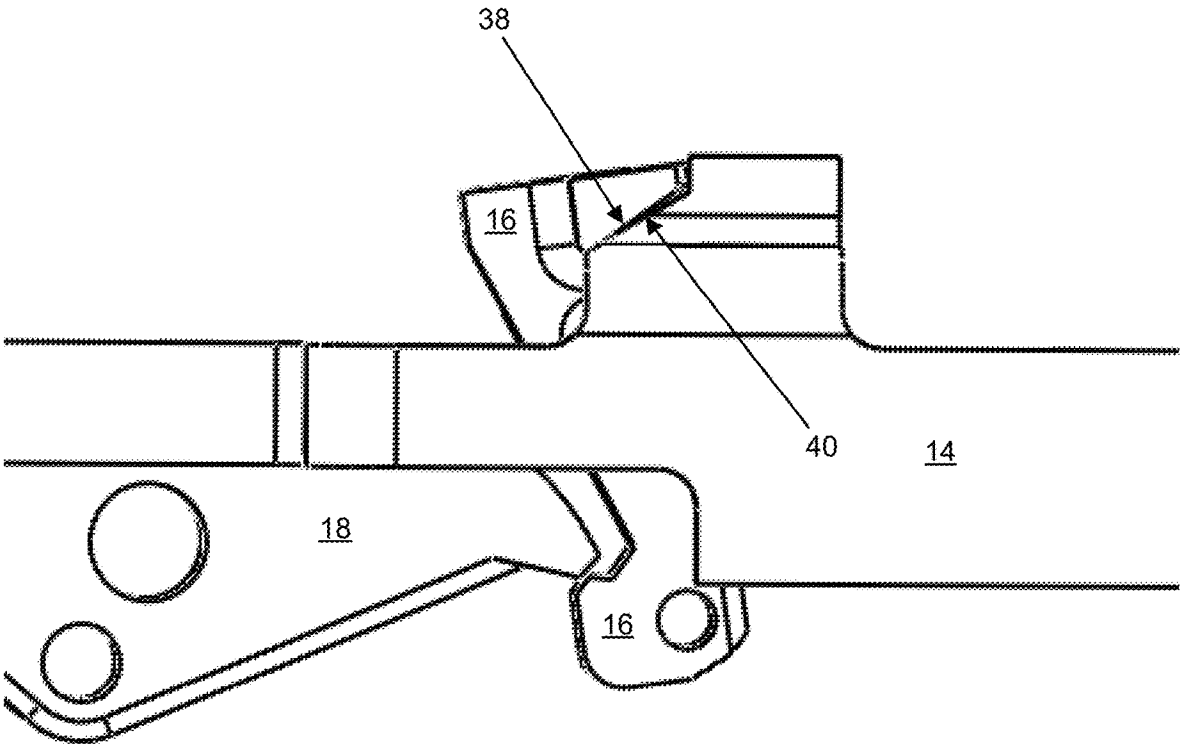

In the illustrated embodiment, the trigger mechanism 10 provides a two-stage trigger pull. FIG. 4 is a close-up side view illustrating initial engagement of a first engagement surface 34 of the trigger bar 14 with a first engagement surface 36 of the sear 16 prior to disconnection of the sear 16 from the hammer 18. In the illustrated embodiment, the trigger bar first engagement surface 34 and the sear first engagement surface 36 are oriented substantially normal to the movement of the trigger bar 14 induced by the reconfiguration of the trigger 12 from the released configuration to the pulled configuration. FIG. 5 is a close-up side view illustrating a subsequent engagement of the first engagement surface 34 of the trigger bar 14 with the first engagement surface 36 of the sear 16 following relative sliding between the surface 34 and the surface 36. FIG. 6 is a close-up side view illustrating engagement of a trigger bar second engagement surface 38 of the trigger bar 14 with a sear second engagement surface 40 of the sear 16 to enable disconnection of the sear 16 from the hammer 18. In the illustrated embodiment, the trigger bar second engagement surface 38 and the sear second engagement surface 40 are angled relative to the trigger bar first engagement surface 34 and the sear first engagement surface 36 by approximately 45 degrees. Any suitable angle can be employed for the angle between the first and second engagement surfaces. The trigger 12 is rotated around the trigger axis 20 through a first actuation angle to reconfigure the trigger mechanism 10 from the starting configuration to a configuration in which the trigger bar first engagement surface 34 contacts the sear first engagement surface 36. The trigger 12 is then further rotated around the trigger axis 20 through a second actuation angle to a configuration in which the trigger bar second engagement surface 38 contacts the sear second engagement surface 40. The trigger 12 is then further rotated around the trigger axis 20 through a third actuation angle to the pulled configuration shown in FIG. 3 in which the sear 16 is in the disengagement configuration and releases the hammer 18 to rotate around the hammer axis 32 from the cocked configuration to the uncocked configuration. The initial actuation of the trigger 18 from the released configuration through the combination of the first and second actuation angles provides a first stage of the trigger pull, which brings the trigger bar second engagement surface 38 into contact with the sear second engagement surface 40, without disconnecting the sear 16 from the hammer 18. The second stage of the trigger pull corresponds to the actuation of the trigger 18 through the third actuation angle, which reconfigures the sear 16 from the configuration shown in FIG. 5 to the disengagement configuration shown in FIG. 6.

In many embodiments, the trigger mechanism 10 includes a firing pin safety that is automatically disengaged via rotation of the hammer 18 after disengagement of the sear 16 from the hammer 18. A hammer-fired firearm in which the trigger mechanism 10 is incorporated can include a firing pin configured to be actuated by the hammer 18 during a reconfiguration of the hammer 18 from the cocked configuration to the uncocked configuration. The firing pin safety can have an engaged configuration and a disengaged configuration. The firing pin safety can be configured to (a) prevent actuation of the firing pin by the hammer 18 when the firing pin safety is in the engaged configuration, (b) accommodate actuation of the firing pin by the hammer 18 when the firing pin safety is in the disengaged configuration, and (c) reconfigure from the engaged configuration to the disengaged configuration during the rotation of the trigger bar 14 around the trigger bar axis 24 induced by reconfiguration of the hammer 18 from the cocked configuration to the uncocked configuration while the trigger 12 is in the pulled configuration. In many embodiments, the firing pin safety includes a firing pin safety spring configured to reconfigure the firing pin safety from the disengaged configuration to the engaged configuration in response to a rotation of the trigger bar 12 around the trigger bar axis 24 induced by a reconfiguration of the hammer 18 from the uncocked configuration to the cocked configuration.

Figure 7:
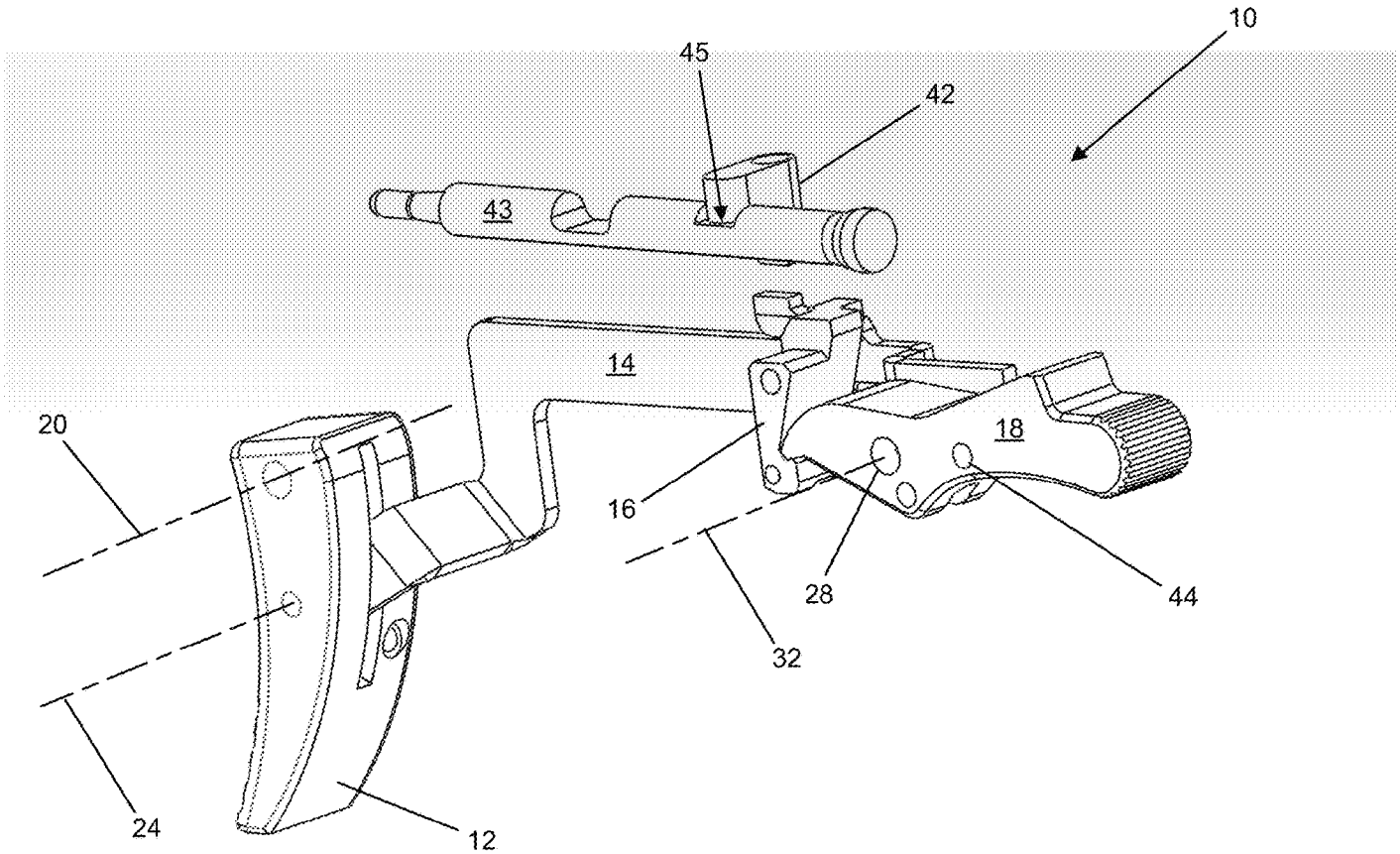
FIG. 7 is a three-dimensional view of the trigger mechanism of FIG. 1 showing engagement of a firing pin safety with a firing pin with the hammer in the cocked configuration and the trigger in the released configuration.
Figure 8:
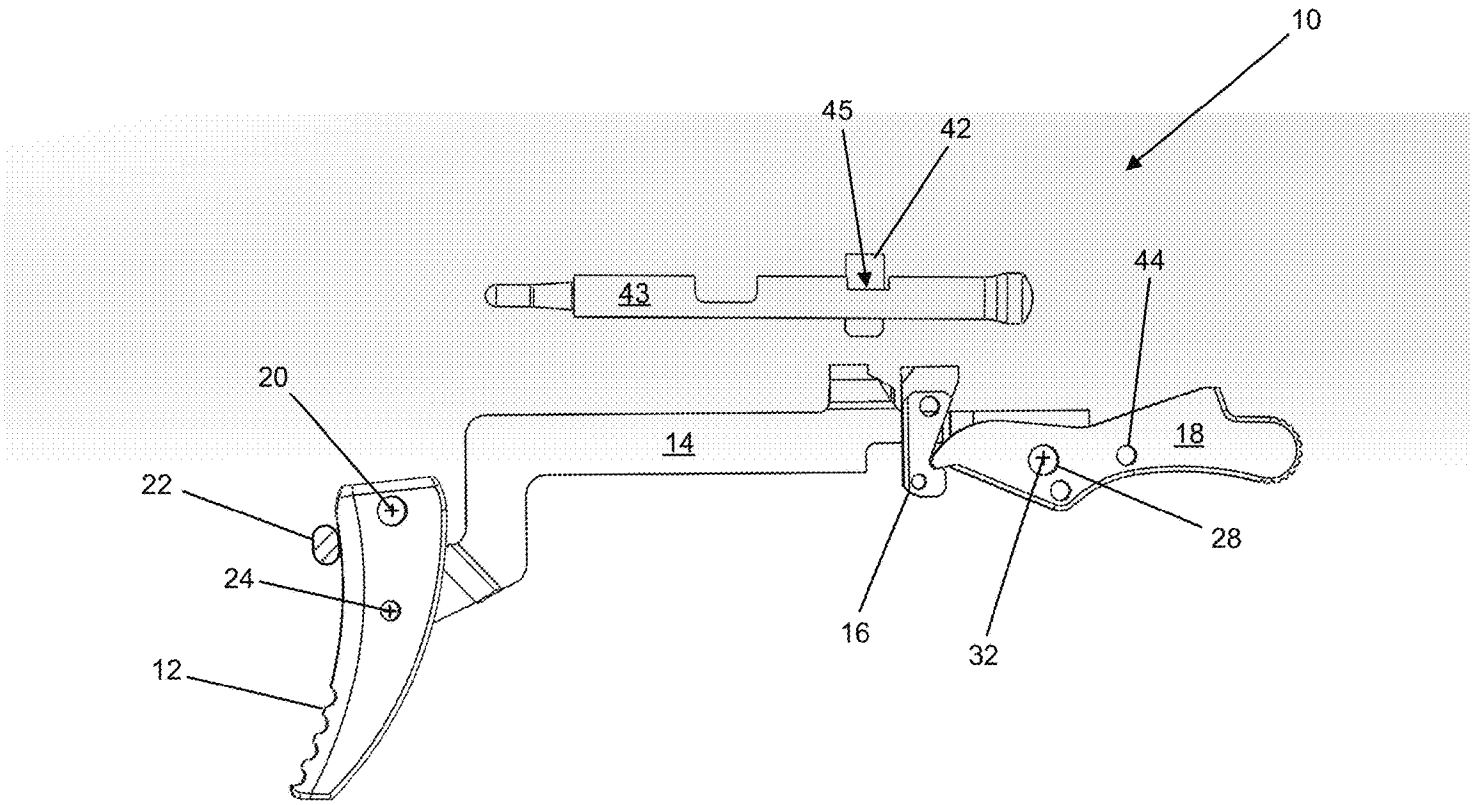
FIG. 8 is a side view of the trigger mechanism of FIG. 1 showing engagement of the firing pin safety with the firing pin with the hammer in the cocked configuration and the trigger in the released configuration.

FIG. 7 and FIG. 8 show a configuration of the trigger mechanism 10 in which a firing pin safety 42 is engaged with a firing pin 43 with the hammer 18 in the cocked configuration and the trigger 12 in the released configuration. In the illustrated embodiment, the firing pin 43 has a recess 45 sized to accommodate a portion of the firing pin safety 42 in the illustrated configuration. In many embodiments, the firing pin safety 42 is biased towards engagement with the recess 45 via a suitable spring. When the firing pin safety 42 is engaged with the recess 45, actuation of the firing pin 43 is blocked, thereby preventing contact between the firing pin 43 and a chambered cartridge.

Figure 9:
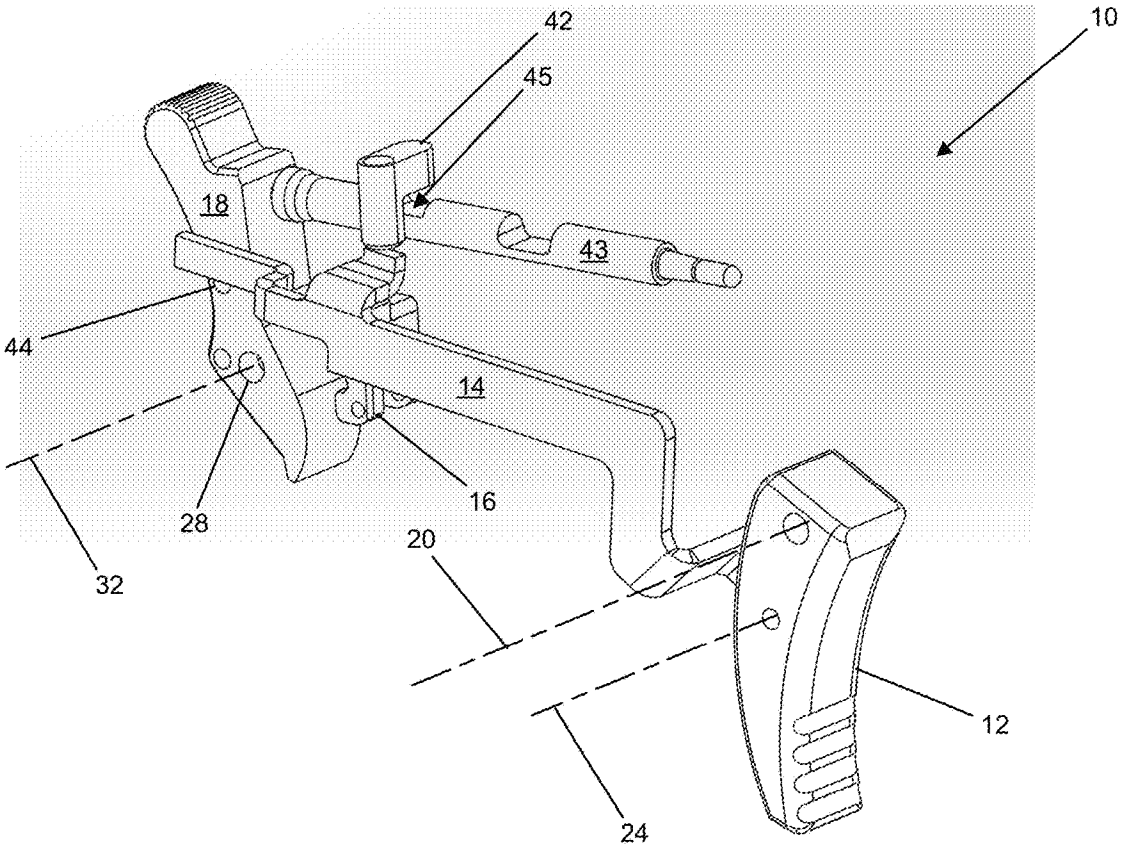
FIG. 9 is a three-dimensional view of the trigger mechanism of FIG. 1 showing disengagement of the firing pin safety from the firing pin induced by rotation of the hammer from the cocked configuration towards the uncocked configuration with the trigger in the pulled configuration.

FIG. 9 is a three-dimensional view of the trigger mechanism 10 showing disengagement of the firing pin safety 42 from the firing pin 43 induced by rotation of the hammer 18 from the cocked configuration towards the uncocked configuration with the trigger 12 in the pulled configuration. The rotation of the hammer 18 from the cocked configuration towards the uncocked configuration induces rotation of the trigger bar 14, which engages the firing pin safety 42 causing disengagement of the firing pin safety 42 from the firing pin 43. Following disconnection of the sear 16 from the hammer 18, the resulting rotation of the hammer 18 around the hammer axis 32 from the cocked configuration towards the uncocked configuration brings a trigger bar cam 44 (attached or integral to the hammer 18) into contact with the trigger bar 14. The trigger bar cam 44 induces a clockwise rotation of the trigger bar 14 around the trigger bar axis 24 relative to the view of FIG. 9. The induced clockwise rotation of the trigger bar 14 around the trigger bar axis 24 brings the trigger bar 14 into contact with the firing pin safety 42 and reconfigures the firing pin safety 42 from the engaged configuration to the disengaged configuration prior to the hammer 18 reaching the uncocked configuration. As a result of the reconfiguration of the firing pin safety 42 prior to the hammer 18 reaching the uncocked configuration, the firing pin 43 can be actuated via the hammer 18 reaching the uncocked configuration.

Any suitable rotation of the trigger bar 14 induced by the hammer 18 can be employed. For example, in the illustrated embodiment, the hammer 18 induces a rotation of the trigger bar 14 of about 7 degrees. Smaller or larger induced rotations of the trigger bar 14 can be used, such as any suitable angle from 2 degrees to 20 degrees.

Figure 10:
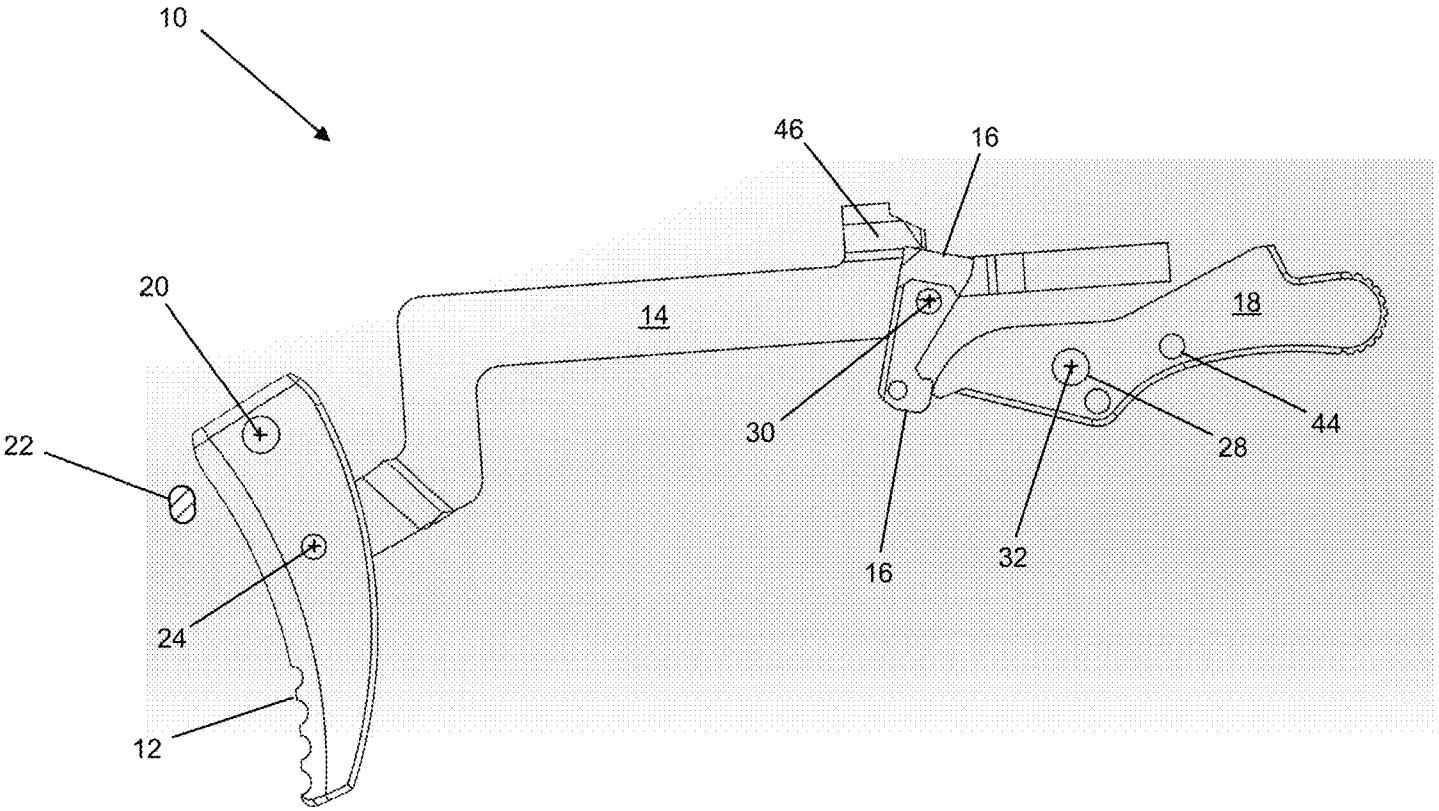
FIG. 10 is a side view of the trigger mechanism of FIG. 1 illustrating semiautomatic functionality via reengagement of the sear with the hammer while the trigger is in the pulled configuration.
Figure 11:
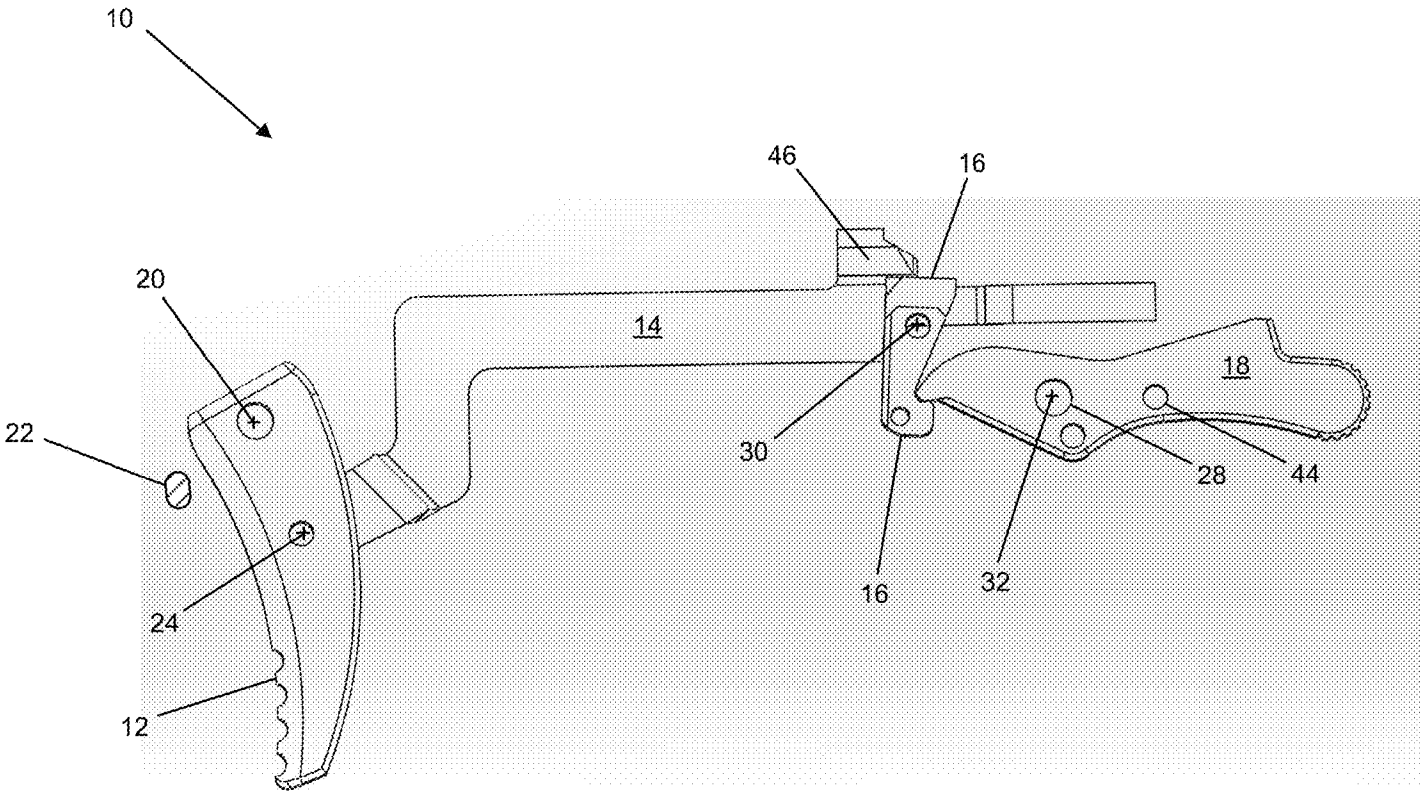
FIG. 11 is a side view of the trigger mechanism of FIG. 1 illustrating semiautomatic functionality via engagement between the sear and the hammer while the trigger is in the pulled configuration.
Figure 12:
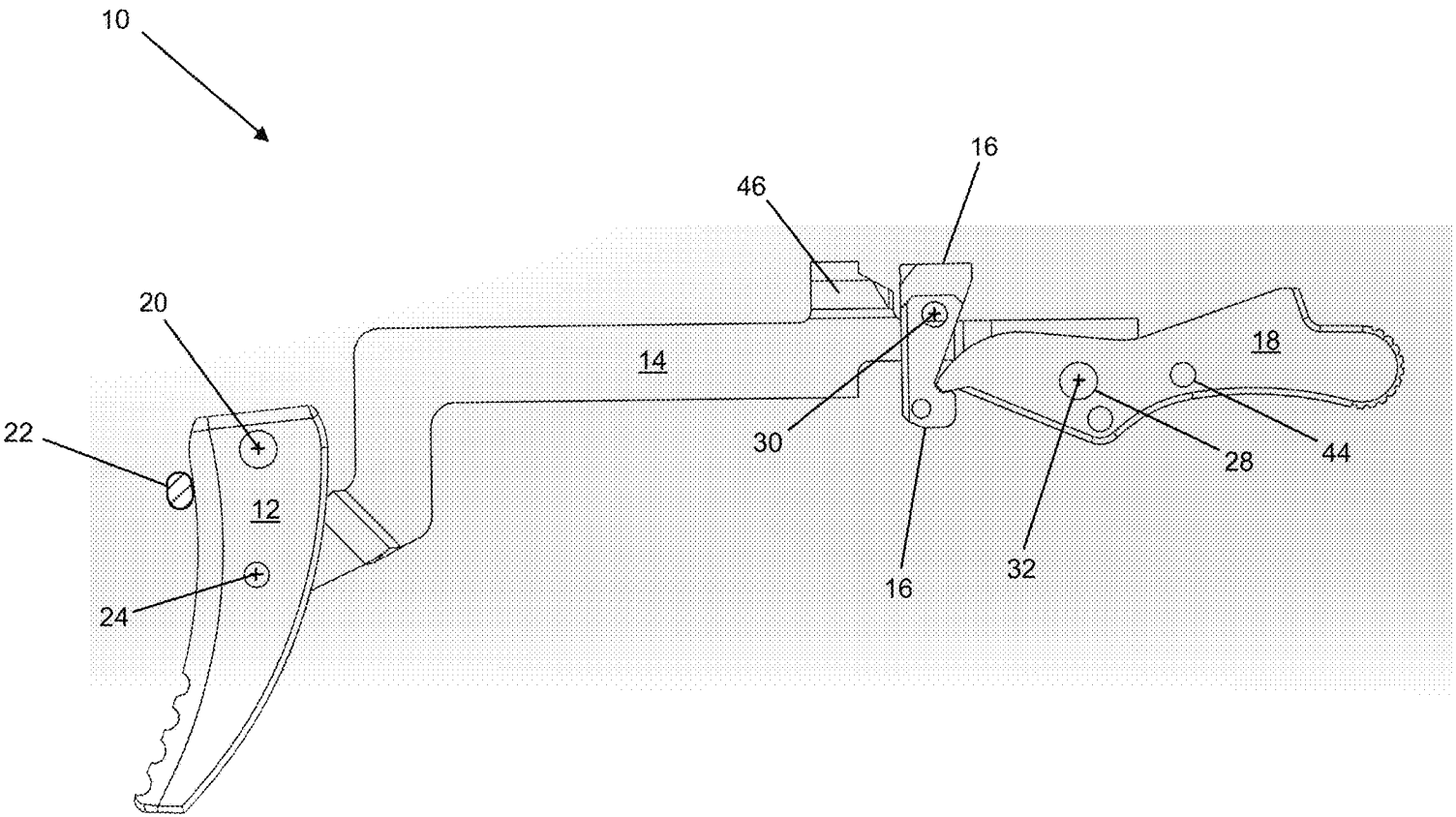
FIG. 12 is a side view of the trigger mechanism of FIG. 1 illustrating semiautomatic functionality via engagement between the sear and the hammer while the trigger is in the released configuration.

In many embodiments, the trigger mechanism 10 provides semi-automatic functionality. While the trigger 12 is in the pulled configuration, the trigger bar 14 can be configured to (a) rotate around the trigger bar axis 24 into engagement with the sear 16 during a reconfiguration of the hammer 18 from the uncocked configuration to the cocked configuration induced by articulation of a slide of the hammer-fired firearm (e.g., during ejection of a spent cartridge), and (b) accommodate reengagement of the sear 16 with the hammer 18 during the reconfiguration of the hammer 18 from the uncocked configuration to the cocked configuration to restrain the hammer 18 in the cocked configuration. FIG. 10 is a side view of the trigger mechanism 10 illustrating semiautomatic functionality via reengagement of the sear 16 with the hammer 18 while the trigger 12 is in the pulled configuration. In the configuration illustrated in FIG. 10, the trigger bar 14 sits on top of the sear 16 as a result of rotating into engagement with the sear 16 during cycling of the slide while the trigger 12 in the pulled configuration. The trigger bar 14 includes a sear engagement feature 46 that, while the trigger 12 is in the pulled configuration, engages a top surface of the sear 16 during the reconfiguration of the hammer 18 from the uncocked configuration to the cocked configuration. In many embodiments, the sear engagement feature 46 is configured to remain in contact with a top surface of the sear 16 during rotation of the sear 16 around the sear axis 30 that occurs during reengagement between the sear 16 and the hammer 18 during the reconfiguration of the hammer 18 from the uncocked configuration to the cocked configuration. In the configuration illustrated in FIG. 11, the trigger bar 14 remains on top of the sear 16 after the sear 16 has rotated around the sear axis 30 to an orientation in which the sear 16 retains the hammer 18 in the cocked configuration. Upon release of the trigger 12, the trigger bar spring induces reconfiguration of the trigger 12 from the pulled configuration to the released configuration and disengages the trigger bar 14 from the sear 16, thereby returning the trigger mechanism 10 to the starting configuration illustrated in FIG. 12.

Figure 13:
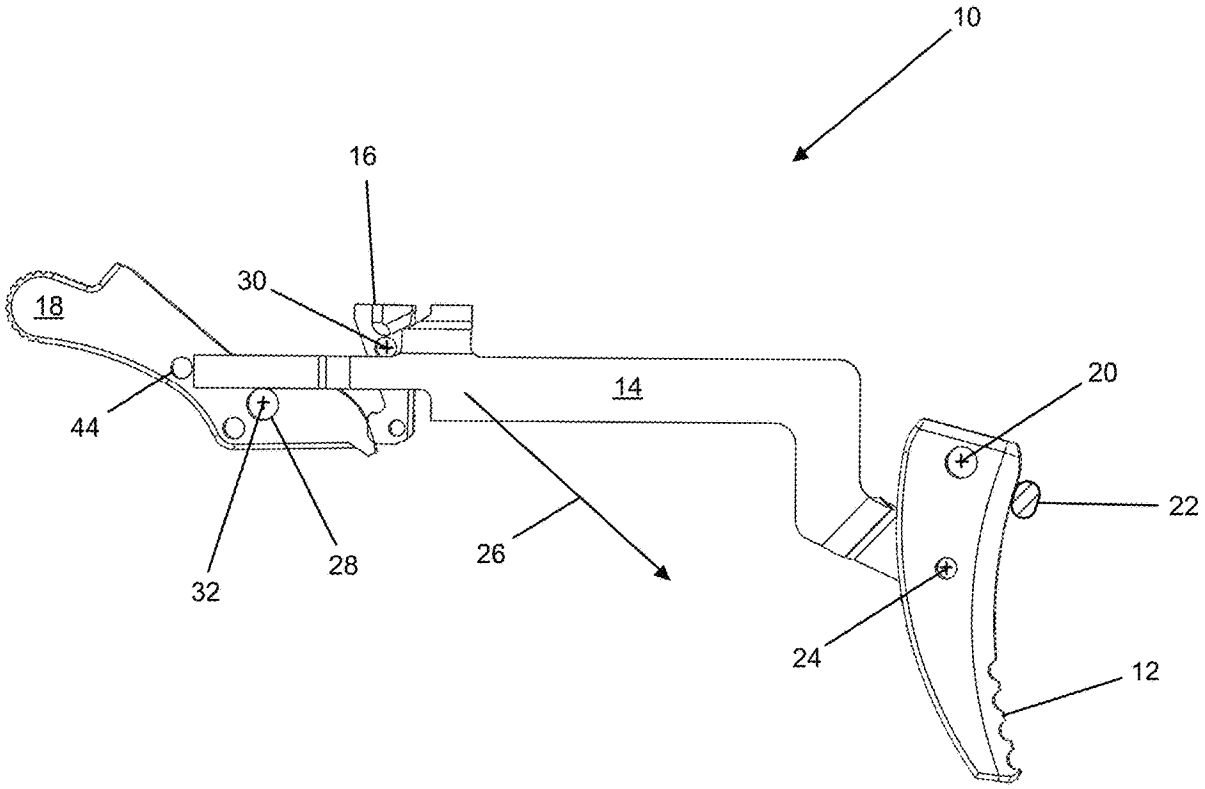
FIG. 13 is a side view illustrating a hammer safety that blocks the hammer from striking the firing pin absent pulling of the trigger in the trigger mechanism of FIG. 1.

In many embodiments, the trigger mechanism 10 is configured to block rotation of the hammer 18 to the uncocked configuration in the advent of disconnection of the sear 16 from the hammer 18 when the trigger 12 is in the released configuration. For example, FIG. 13 is a side view illustrating blocking of rotation of the hammer 18 to the uncocked configuration via engagement between the trigger bar cam 44 and an end surface of the trigger bar 14 while the trigger 12 is in the released configuration. In contrast, when the trigger 12 is in the pulled configuration as shown in FIG. 3, the trigger bar 14 is positioned so as to be rotated around the trigger bar axis 14 by the trigger bar cam 44 instead of being positioned to block rotation of the hammer 18 via engagement between the end surface of the trigger bar 14 and the trigger bar cam 44 as illustrated in FIG. 13.

Figure 14:
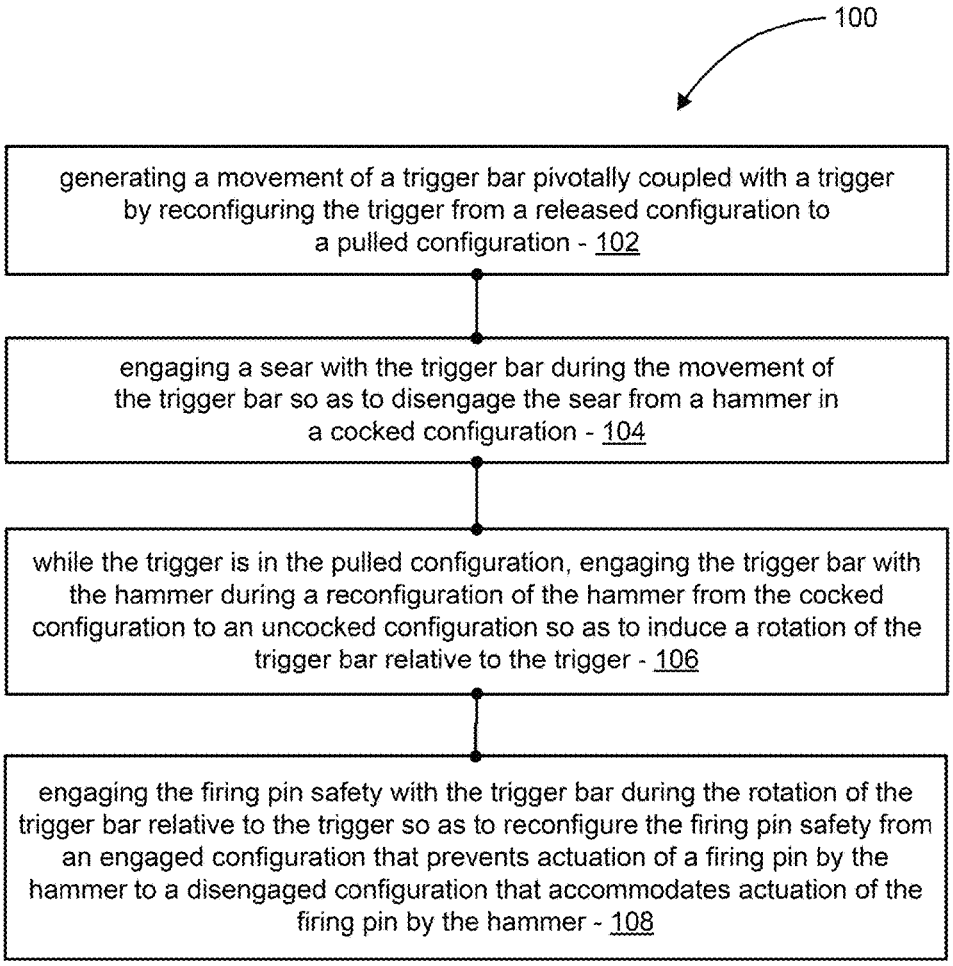
FIG. 14 is a simplified block diagram of a method of operating a firing pin safety of a hammer-fired firearm, in accordance with embodiments.

FIG. 14 is a simplified block diagram of acts of a method 100 of operating a firing pin safety of a hammer-fired firearm, in accordance with embodiments. The method 100 can be practiced with respect to any suitable hammer-fired firearm, such as a hammer-fired firearm incorporating the trigger mechanism 10 described herein.

The method 100 includes generating a movement of a trigger bar pivotally coupled with a trigger by reconfiguring the trigger from a released configuration to a pulled configuration (act 102). For example, in the trigger mechanism 10, the trigger bar 14 is pivotally coupled to the trigger 12 at trigger bar axis 24. The movement of the trigger bar 14 is generated by reconfiguring the trigger 12 from the released configuration shown in FIG. 2 to the pulled configuration shown in FIG. 3.

The method 100 further includes engaging a sear with the trigger bar during the movement of the trigger bar so as to disengage the sear from a hammer in a cocked configuration (act 104). For example, in the trigger mechanism 10, the sear 16 is engaged with the trigger bar 16 during the movement of the trigger bar 14 so as to disengage the sear 16 from the hammer 18 in the cocked configuration as shown in FIG. 3 through FIG. 6.

The method 100 further includes, while the trigger is in the pulled configuration, engaging the trigger bar with the hammer during a reconfiguration of the hammer from the cocked configuration to an uncocked configuration so as to induce a rotation of the trigger bar relative to the trigger (act 106). For example, in the configuration of the trigger mechanism 10 illustrated in FIG. 9 the trigger 12 is in the pulled configuration. Following disconnection of the sear 16 from the hammer 18, the hammer 18 rotates around the hammer axis 32 from the cocked configuration to the uncocked configuration. During the rotation of the hammer 18 around the hammer axis 32, the trigger bar cam 44 engages the trigger bar 14 and induces rotation of the trigger bar 14 around the trigger bar axis 24 relative to the trigger 12.

The method 100 further includes engaging the firing pin safety with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer (act 108). For example, in the configuration of the trigger mechanism 10 illustrated in FIG. 9, the rotation of the trigger bar 14 around the trigger bar axis 24 induced by rotation of the hammer 18 around the hammer axis 32 brings the trigger bar 14 into engagement with the firing pin safety 42 and reconfigures the firing pin safety 42 from an engaged configuration that prevents actuation of a firing pin by the hammer 18 to a disengaged configuration that accommodates actuation of the firing pin by the hammer 18.

Figure 15:
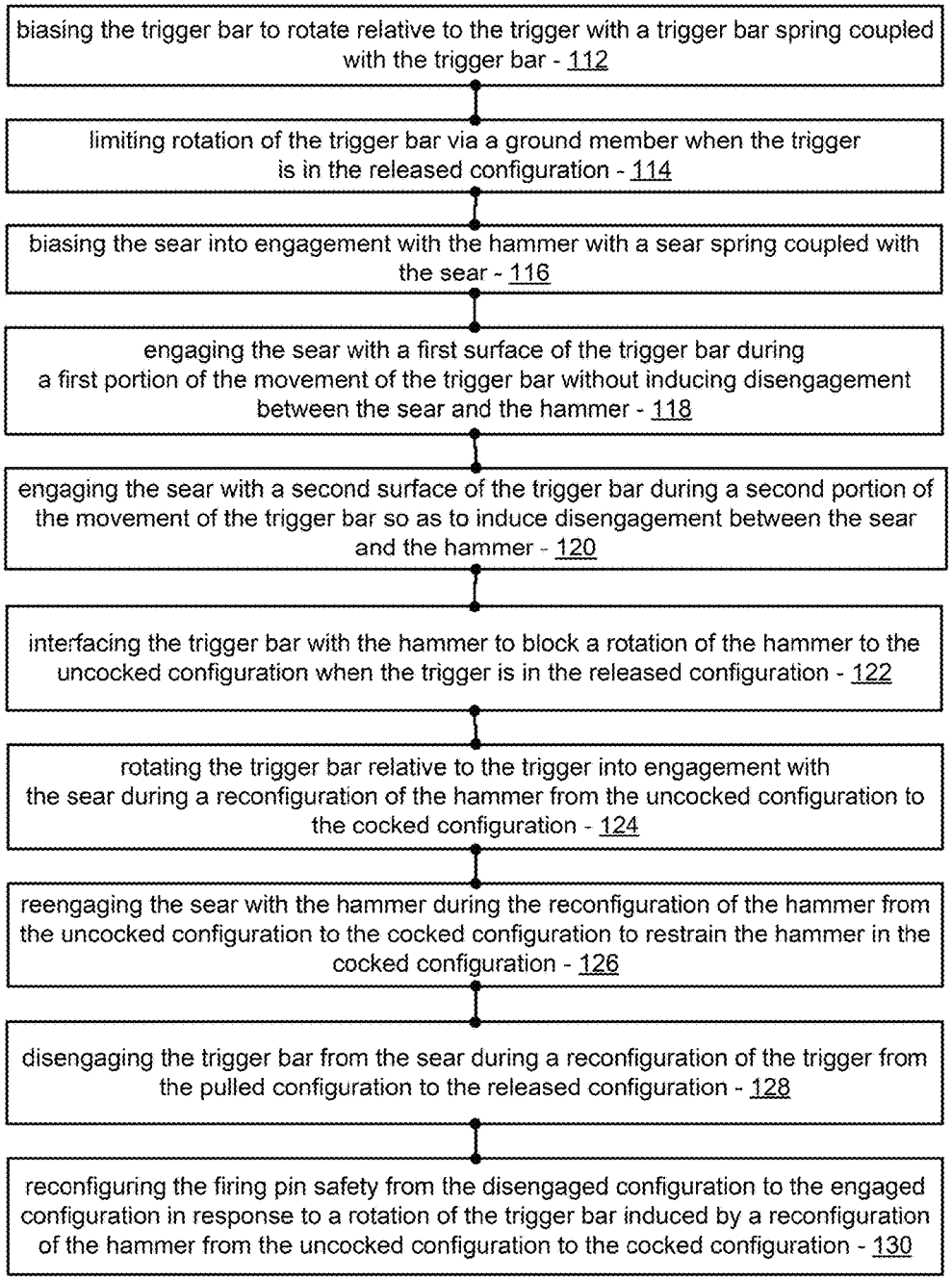
FIG. 15 is a simplified block diagram of additional acts that can be accomplished in the method of FIG. 10.

FIG. 15 is a simplified block diagram of additional acts that can be accomplished in the method 100. The additional acts can include (a) biasing the trigger bar 14 to rotate relative to the trigger 12 with a trigger bar spring coupled with the trigger bar 14 (act 112); (b) limiting rotation of the trigger bar 14 via a ground member (e.g., hammer pivot pin 28) when the trigger 12 is in the released configuration (act 114); (c) biasing the sear 16 into engagement with the hammer 18 with a sear spring coupled with the sear 16 (act 116), (d) engaging the sear 16 with a first surface 34 of the trigger bar 14 during a first portion of the movement of the trigger bar 14 without inducing disengagement between the sear 16 and the hammer 18 (act 118), (e) engaging the sear 16 with a second surface 38 of the trigger bar 14 during a second portion of the movement of the trigger bar 14 so as to induce disengagement between the sear 16 and the hammer 18 (act 120) (the second surface 38 can be angled relative to the first surface 34 by at least 40 degrees); (f) interfacing the trigger bar 14 with the hammer 18 (e.g., via the trigger bar cam 44) to block a rotation of the hammer 18 to the uncocked configuration when the trigger 12 is in the released configuration (act 122); (g) while the trigger 12 is in the pulled configuration, rotating the trigger bar 14 relative to the trigger 12 into engagement with the sear 16 during a reconfiguration of the hammer 18 from the uncocked configuration to the cocked configuration (act 124); (h) while the trigger 12 is in the pulled configuration, reengaging the sear 16 with the hammer 18 during the reconfiguration of the hammer 18 from the uncocked configuration to the cocked configuration to restrain the hammer 18 in the cocked configuration (act 126); (i) disengaging the trigger bar 14 from the sear 16 during a reconfiguration of the trigger 12 from the pulled configuration to the released configuration (act 128); and (j) reconfiguring the firing pin safety 42 from the disengaged configuration to the engaged configuration in response to a rotation of the trigger bar 14 induced by a reconfiguration of the hammer 18 from the uncocked configuration to the cocked configuration.

Figure 16:
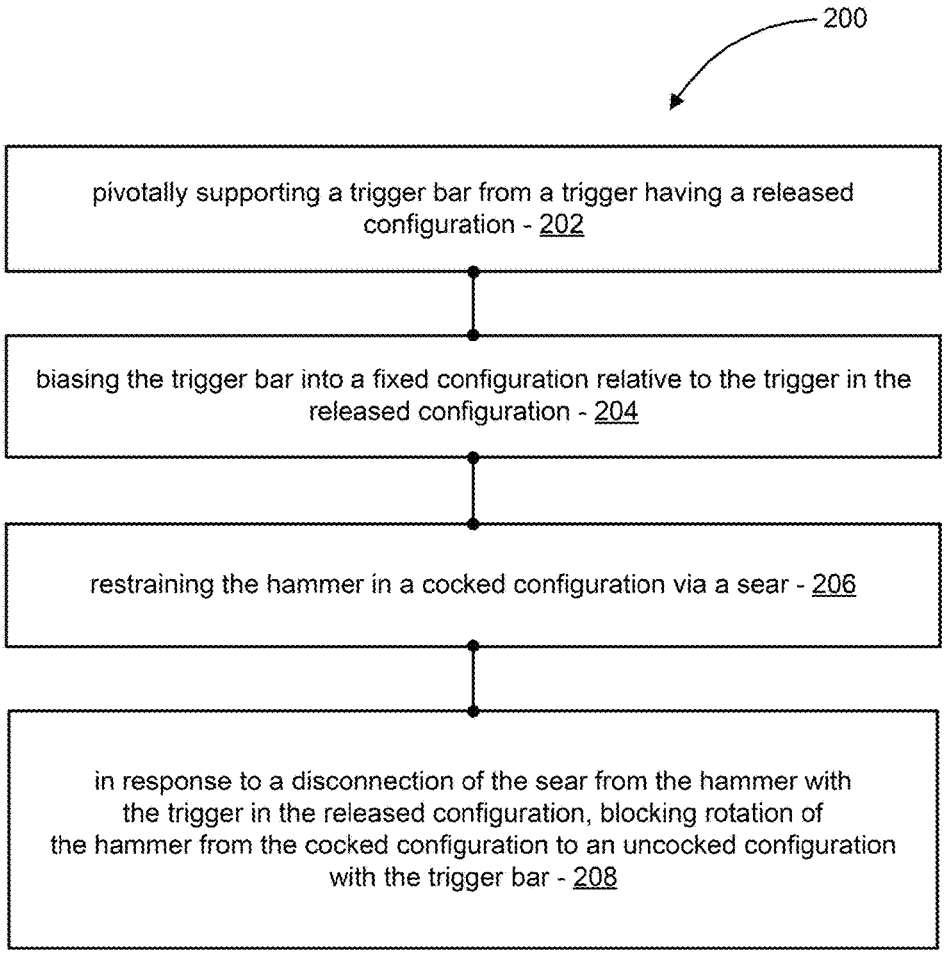
FIG. 16 is a simplified block diagram of a method of blocking rotation of a hammer to prevent actuation of a firing pin when a trigger of the hammer-fired firearm is in a released configuration, in accordance with embodiments.

FIG. 16 is a simplified block diagram of acts of a method 200 of blocking rotation of a hammer to prevent actuation of a firing pin when a trigger of the hammer-fired firearm is in a released configuration, in accordance with embodiments. The method 200 can be practiced with respect to any suitable hammer-fired firearm, such as a hammer-fired firearm incorporating the trigger mechanism 10 described herein. The method 200 includes (a) pivotally supporting a trigger bar 14 from a trigger 12 having a released configuration (act 202); (b) biasing the trigger bar 14 into a fixed configuration relative to the trigger 12 in the released configuration (act 204); (c) restraining the hammer 18 in a cocked configuration via a sear 16 (act 206); and (d) in response to a disconnection of the sear 16 from the hammer 18 with the trigger 12 in the released configuration, blocking rotation of the hammer 18 from the cocked configuration to an uncocked configuration with the trigger bar 14 (act 208).

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A trigger mechanism for a hammer-fired firearm, the trigger mechanism comprising:

a trigger having a released configuration and a pulled configuration;

a trigger bar pivotally coupled with the trigger to rotate around a trigger bar axis, the trigger bar being biased to rotate around the trigger bar axis in a biasing direction;

a pivotally-mounted hammer configured to rotate around a hammer axis between a cocked configuration and an uncocked configuration, the hammer comprising a trigger bar cam configured to induce a rotation of the trigger bar around the trigger bar axis opposite to the biasing direction during a reconfiguration of the hammer from the cocked configuration to the uncocked configuration while the trigger is in the pulled configuration, the hammer being biased to rotate around the hammer axis toward the uncocked configuration from the cocked configuration;

a pivotally-mounted sear configured to rotate around a sear axis between an engagement configuration and a disengagement configuration, the sear being configured to restrain the hammer in the cocked configuration when the sear is in the engagement configuration and accommodate rotation of the hammer around the hammer axis from the cocked configuration to the uncocked configuration when the sear is in the disengagement configuration, the sear being configured to rotate from the engagement configuration to the disengagement configuration in response to a movement of the trigger bar induced by a reconfiguration of the trigger from the released configuration to the pulled configuration.

2. The trigger mechanism of claim 1, wherein a rotation of the trigger bar around the trigger bar axis is limited in the biasing direction.

3. The trigger mechanism of claim 2, wherein the rotation of the trigger bar around the trigger bar axis is limited in the biasing direction by a hammer pivot pin by which the hammer is pivotally mounted to a frame of the hammer-fired firearm.

4. The trigger mechanism of claim 1, wherein the sear is biased to rotate around the sear axis toward the engagement configuration from the disengagement configuration.

5. The trigger mechanism of claim 1, wherein the trigger bar comprises:

a first engagement surface configured to engage the sear during a first portion of the movement of the trigger bar induced by the reconfiguration of the trigger from the released configuration to the pulled configuration without inducing disengagement between the sear and the hammer; and a second engagement surface configured to engage the sear during a second portion of the movement of the trigger bar induced by the reconfiguration of the trigger from the released configuration to the pulled configuration so as to induce disengagement between the sear and the hammer.

6. The trigger mechanism of claim 5, wherein:

the first engagement surface is oriented substantially normal to the movement of the trigger bar induced by the reconfiguration of the trigger from the released configuration to the pulled configuration; and the second engagement surface is angled relative to the first engagement surface by at least 40 degrees.

7. The trigger mechanism of claim 1, wherein the trigger bar is configured to interface with the trigger bar cam to block a rotation of the hammer toward the uncocked configuration when the trigger is in the released configuration.

8. The trigger mechanism of claim 1, wherein when the trigger is in the pulled configuration, the trigger bar is configured to:

rotate around the trigger bar axis in the biasing direction into engagement with the sear during a reconfiguration of the hammer from the uncocked configuration to the cocked configuration; and accommodate reengagement of the sear with the hammer during the reconfiguration of the hammer from the uncocked configuration to the cocked configuration to restrain the hammer in the cocked configuration.

9. The trigger mechanism of claim 8, wherein the trigger bar is configured to disengage from the sear during a reconfiguration of the trigger from the pulled configuration to the released configuration.

10. The trigger mechanism of claim 1, further comprising:

a firing pin configured to be actuated by the hammer during a reconfiguration of the hammer from the cocked configuration to the uncocked configuration; and a firing pin safety having an engaged configuration and a disengaged configuration, the firing pin safety being configured to:

prevent actuation of the firing pin by the hammer when the firing pin safety is in the engaged configuration;

accommodate actuation of the firing pin by the hammer when the firing pin safety is in the disengaged configuration; and reconfigure from the engaged configuration to the disengaged configuration during the rotation of the trigger bar around the trigger bar axis opposite to the biasing direction during the reconfiguration of the hammer from the cocked configuration to the uncocked configuration while the trigger is in the pulled configuration.

11. The trigger mechanism of claim 10, wherein the firing pin safety reconfigures from the disengaged configuration to the engaged configuration in response to a rotation of the trigger bar around the trigger bar axis in the biasing direction induced by a reconfiguration of the hammer from the uncocked configuration to the cocked configuration.

12. A method of operating a firing pin safety of a hammer-fired firearm, the method comprising:

generating a movement of a trigger bar pivotally coupled with a trigger by reconfiguring the trigger from a released configuration to a pulled configuration;

engaging a sear with the trigger bar during the movement of the trigger bar so as to disengage the sear from a hammer in a cocked configuration;

while the trigger is in the pulled configuration, engaging the trigger bar with the hammer during a reconfiguration of the hammer from the cocked configuration to an uncocked configuration so as to induce a rotation of the trigger bar relative to the trigger; and engaging the firing pin safety with the trigger bar during the rotation of the trigger bar relative to the trigger so as to reconfigure the firing pin safety from an engaged configuration that prevents actuation of a firing pin by the hammer to a disengaged configuration that accommodates actuation of the firing pin by the hammer.

13. The method of claim 12, further comprising:

biasing the trigger bar to rotate relative to the trigger; and limiting rotation of the trigger bar when the trigger is in the released configuration.

14. The method of claim 12, further comprising biasing the sear into engagement with the hammer.

15. The method of claim 12, further comprising:

engaging the sear with a first surface of the trigger bar during a first portion of the movement of the trigger bar without inducing disengagement between the sear and the hammer; and engaging the sear with a second surface of the trigger bar during a second portion of the movement of the trigger bar so as to induce disengagement between the sear and the hammer, the second surface being angled relative to the first surface by at least 40 degrees.

16. The method of claim 12, further comprising interfacing the trigger bar with the hammer to block a rotation of the hammer to the uncocked configuration when the trigger is in the released configuration.

17. The method of claim 12, further comprising:

while the trigger is in the pulled configuration, rotating the trigger bar relative to the trigger into engagement with the sear during a reconfiguration of the hammer from the uncocked configuration to the cocked configuration; and reengaging the sear with the hammer during the reconfiguration of the hammer from the uncocked configuration to the cocked configuration to restrain the hammer in the cocked configuration.

18. The method of claim 17, further comprising disengaging the trigger bar from the sear during a reconfiguration of the trigger from the pulled configuration to the released configuration.

19. The method of claim 12, further comprising reconfiguring the firing pin safety from the disengaged configuration to the engaged configuration in response to a rotation of the trigger bar induced by a reconfiguration of the hammer from the uncocked configuration to the cocked configuration.

20. A method of blocking rotation of a hammer to prevent actuation of a firing pin when a trigger of a hammer-fired firearm is in a released configuration, the method comprising:

pivotally supporting a trigger bar from a trigger having a released configuration;

biasing the trigger bar into a fixed configuration relative to the trigger in the released configuration;

restraining the hammer in a cocked configuration via a sear; and in response to a disconnection of the sear from the hammer with the trigger in the released configuration, blocking rotation of the hammer from the cocked configuration to an uncocked configuration via contact between the hammer and the trigger bar.

* * * * *